US006702630B2

(12) United States Patent
Walkowiak

(10) Patent No.: US 6,702,630 B2
(45) Date of Patent: Mar. 9, 2004

(54) AUXILIARY KEEL SYSTEM FOR MARINE CRAFTS POWERED BY JET PROPULSION SYSTEMS

(76) Inventor: Jeffrey T. Walkowiak, 5005 93rd Ave. North, Pinellas Park, FL (US) 33782

( * ) Notice: Subject to any disclaimer, the term of this patent is extended or adjusted under 35 U.S.C. 154(b) by 0 days.

(21) Appl. No.: 10/387,951

(22) Filed: Mar. 13, 2003

(65) Prior Publication Data

US 2003/0176120 A1 Sep. 18, 2003

Related U.S. Application Data

(63) Continuation-in-part of application No. 10/100,330, filed on Mar. 18, 2002, now Pat. No. 6,561,858.

(51) Int. Cl.[7] ..... B63H 11/117
(52) U.S. Cl. ..... 440/43; 440/41; 114/162
(58) Field of Search ..... 440/40, 41, 42, 440/43; 114/162, 164, 146, 144 R, 151

(56) References Cited

U.S. PATENT DOCUMENTS 3,244,135 A 4/1966 Meyerhoff
3,961,591 A 6/1976 Fuller
3,982,494 A 9/1976 Posti
4,421,489 A 12/1983 Van Veldhuizen
6,415,729 B1 7/2002 Nedderman et al.

OTHER PUBLICATIONS

Bombardier Inc., "SEA DOO Watercraft 2002," Bombardier Inc.

*Primary Examiner*—Stephen Avila
(74) *Attorney, Agent, or Firm*—Dennis G. LaPointe; Mason Law, P.A.

(57) ABSTRACT

The invention relates to an auxiliary system for providing positive steering to marine crafts using jet propulsion systems, typically personal jet driven watercrafts such as jet boats and jet skis. In one embodiment, it includes, among other features, a combination of keel members attached to a stern section of a hull. The keels are interconnected using tie rods to the directional steering drive assembly. In other embodiments, the keels are instead attached directly to the directional nozzle or integrally made with the nozzle, and where a hood is included in the directional nozzle assembly, notches may be included in the keels to allow for full operation of the hood into its lowest position.

52 Claims, 21 Drawing Sheets

AUXILIARY KEEL SYSTEM FOR MARINE CRAFTS POWERED BY JET PROPULSION SYSTEMS

RELATED APPLICATION

This application is a continuation-in-part of U.S. patent application Ser. No. 10/100,330 filed Mar. 18, 2002, now U.S. Pat. No. 6,561,858 issued May 13, 2003.

The invention relates to an auxiliary system for providing positive steering to marine crafts using jet propulsion systems, typically personal jet driven watercrafts such as jet boats and jet skis.

By way of background, there are two types of jet propulsion systems currently in use. The first type most commonly used is found on personal watercrafts usually referred to as Jet Skis. This type uses a directional nozzle. The nozzle turns from side to side directing water from the jet to change the direction of the watercraft.

The second type is commonly used on Jet Boats. This type of system incorporates a movable hood or cover over the directional nozzle to force the water from the jet below the boat to add reverse thrust and allows the boat to back up. For forward thrust, it is pulled up above the jet nozzle.

In both types, the steering of the watercraft relies completely on the direction and force of the water being expelled from the directional nozzle. This steering method is extremely unreliable as it responds slowly and fails totally if power is reduced or turned off. As a result, there have been many deadly accidents as a result of such watercraft not being able to quickly and positively respond to a need for directional change at any speed, even if engine power is cut off.

The present invention addresses this steering deficiency currently found in existing watercrafts powered by jet propulsion systems by incorporating an auxiliary keel system to dramatically enhance the steering performance of such watercrafts. In normal operation, the keel steering enhances the watercraft's maneuverability with immediate and controlled response.

In operating conditions where the operator reduces the jet power or stalls the engine, the keel steering takes over and the watercraft will steer accurately. Consequently, the present invention makes the operation of jet propelled watercrafts more enjoyable and, more importantly, much safer.

Although the present invention is more fully described hereinafter, in general, the present invention includes, among other features, a combination of keel members attached to a stern section of a hull. The keels are interconnected using tie rods to the directional steering drive assembly. In other embodiments, the keels are instead attached directly to the directional nozzle or incorporated into the manufacture of the directional nozzle as one piece, and where a hood is included in the directional nozzle assembly, notches are included in the keels to allow for full operation of the hood into its lowest position. For the latter embodiments, although one center keel will work, a divergently depending two keel system or a two keel system together with a center keel further enhance the watercraft steering performance.

For safety purposes, the bottom edges of the keels are preferably rounded off with a radius of at least 3/16 inch. This feature can also be included by gradually tapering the keels to widen at the bottom edges to accommodate the rounded bottoms.

In addition, in circumstances where the keel member are designed to be part of the directional nozzle, then the tapered keel may be hollow such that a portion of the outlet flow of water can also be directed through the hollow portion of the keel members and exit the back edge of the keel members in a substantially parallel direction to the general flow of the water out the directional nozzle.

If more positive reaction to steering is desired or even less positive reaction to steering is desired, than the contemplated 1:1 response in the embodiment using tie rods described below, an odd number of apertures, linearly arranged where the tie rod ends are connected together could be provided so that an owner can adjust the sensitivity of the steering response by connecting the tie rod ends to the central aperture for 1:1 response, to an aperture closer to the stern for a little less rapid and lesser response (less than 1:1) and to an aperture further away for a more rapid and greater response (greater than 1:1).

In still another embodiment of the invention, two more keel members can be incorporated into a directional nozzle with a ridge being formed along either side of the directional nozzle so as to form cupped sides between each outside keel member and the ridges. It is also preferred, but not necessary, that a cup be formed on the directional nozzle between the keel members as well. Where the outside keel members depend relatively straight down from the directional nozzle, it is recommended that the most bottom ends of each outside keel member (when two or three keel members are included) be formed to bow or slightly bend outwardly.

In the accompanying drawings:

FIG. 1*a* is a depiction of the present invention attached to a jet boat with the hood in the "UP" position for forward motion;

FIG. 1*b* is a depiction of the embodiment of FIG. 1*a* with the directional nozzle and the keels of the present invention turned to make a right turn with the jet boat;

FIG. 1*c* is a depiction of the embodiment of FIG. 1*a* with the hood in the "DOWN" position for creating a reverse thrust in the jet boat;

FIG. 1*d* is a depiction of one application of the present invention used in FIGS. 1*a*–1*c;*

FIG. 1*e* is a depiction of a practical application of an alternative attachment bracket to interconnect the tie rods from the directional nozzle drive assembly;

FIG. 1*f* is a depiction of one example for providing angular adjustment means to accommodate the angle of the stern;

FIG. 2*a* is a depiction of another embodiment of the present invention that provides for the installation of a keel system directly to the directional nozzle outlet;

FIG. 2*b* is a depiction of another embodiment of the invention depicted in FIG. 2*a*, except that the keels members are detachable from the C-shaped portion that is mounted over the directional nozzle;

FIG. 3*a* is a depiction of another embodiment of the present invention for use on personal watercrafts such as jet skis;

FIG. 3*b* is a depiction of another embodiment of the invention of FIG. 3*a*, except that the generally C-shaped portion is formed by the assembly of parts that allows for the keel members to be replaced without having to replace the portion that attaches to the directional nozzle;

FIG. 3*c* is a depiction of the invention of either FIG. 3*a* or FIG. 3*b* attached to the directional nozzle of a jet ski;

FIG. 3*d* is a representation of the invention of FIGS. 3*a* or 3*b* attached to a jet ski with the normal forward movement water line and the keel members submerged below the water line;

FIG. 3*e* is a further representation as in FIG. 3*d* except that the jet ski is leaning to the starboard to initiate a right turn and the lowered right side keel member provides control assistance to the operator;

FIG. 3*f* is also a further representation as in FIG. 3*d* except that when the personal watercraft proceeds at high speeds, the keel members remain relatively below the water line for maintaining turn control at high speeds;

FIG. 4 depicts another embodiment where the keel members are part of the directional nozzle;

FIG. 5*a* is a conceptual depiction of a directional nozzle with a single center keel depending therefrom;

FIG. 5*b* is a conceptual depiction of a directional nozzle with two spaced-apart and divergently depending keel members depending from the nozzle;

FIG. 5*c* is a conceptual depiction of a directional nozzle with three keel members;

FIG. 6*a* is a conceptual depiction of a directional nozzle with a detachable single center keel depending therefrom;

FIG. 6*b* is a conceptual depiction of a directional nozzle with two detachable spaced-apart and divergently depending keel members depending from the nozzle;

FIG. 6*c* is a conceptual depiction of a directional nozzle with three detachable keel members depending from the nozzle;

FIG. 7*a* is a depiction of another embodiment of the keel with a rounded portion on its bottom edge;

FIG. 7*b* is a cross-sectional view taken from FIG. 7*a;*

FIG. 8*a* is a depiction of another embodiment of the keel similar to that of FIG. 7*a*, except that the rounded portion is formed from a gradual tapering of the keel member;

FIG. 8*b* is cross-sectional view taken from FIG. 8*a;*

Figure 11A:
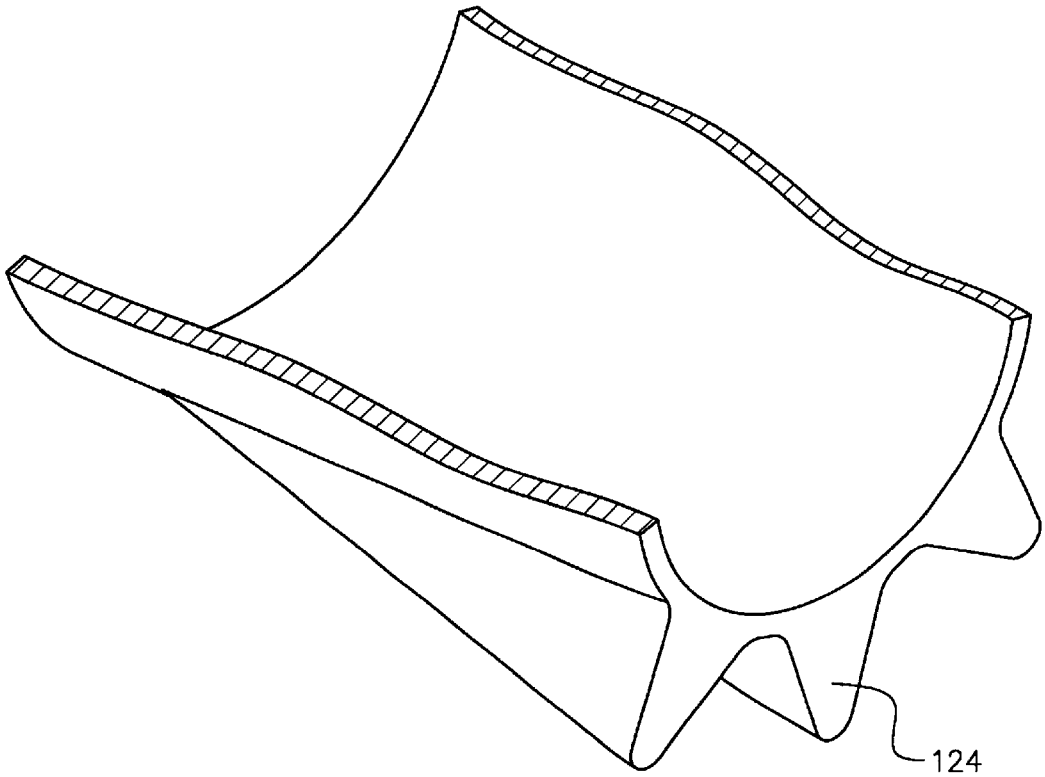
Figure 11B:
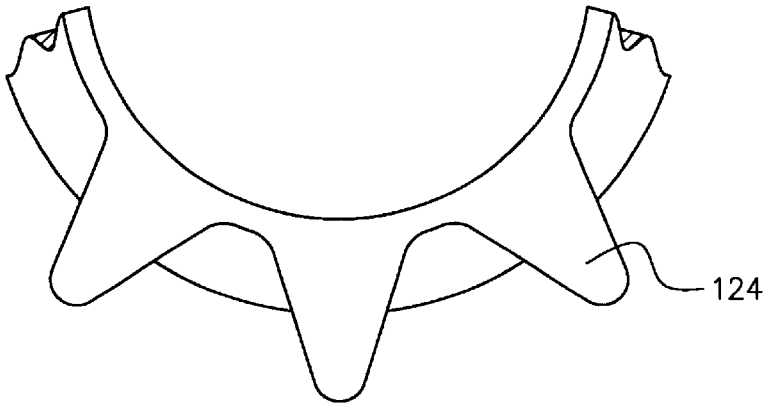
Figure 12A:
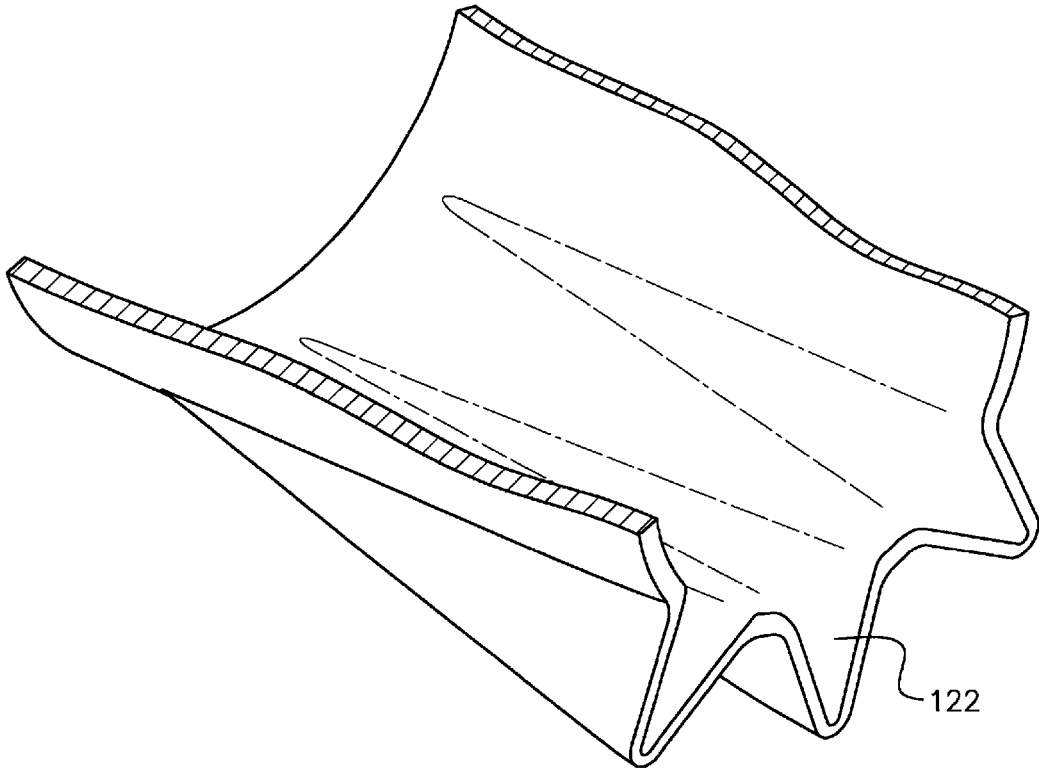
Figure 12B:
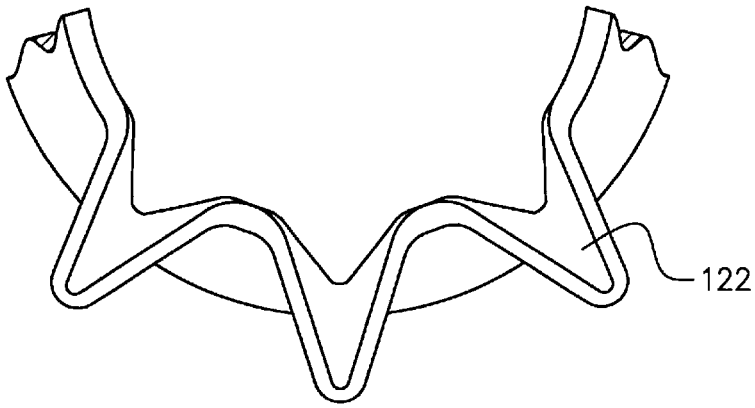
Figure 13A:
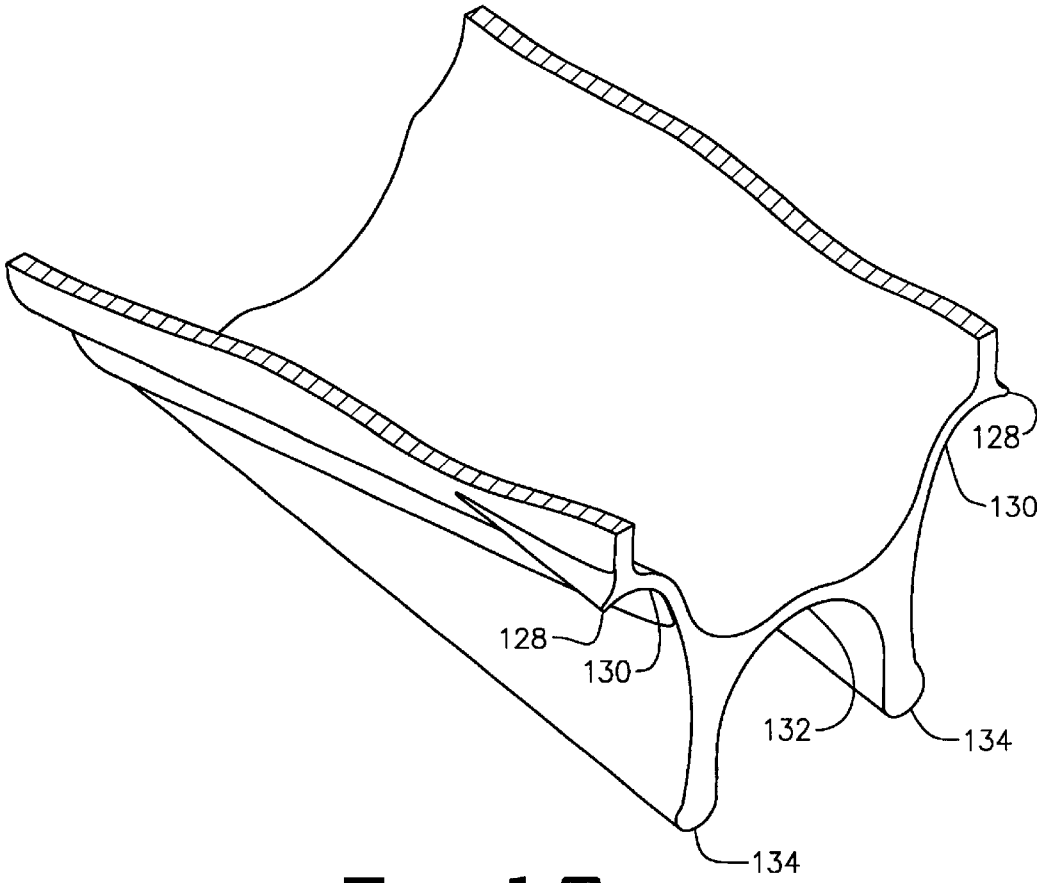
Figure 13B:
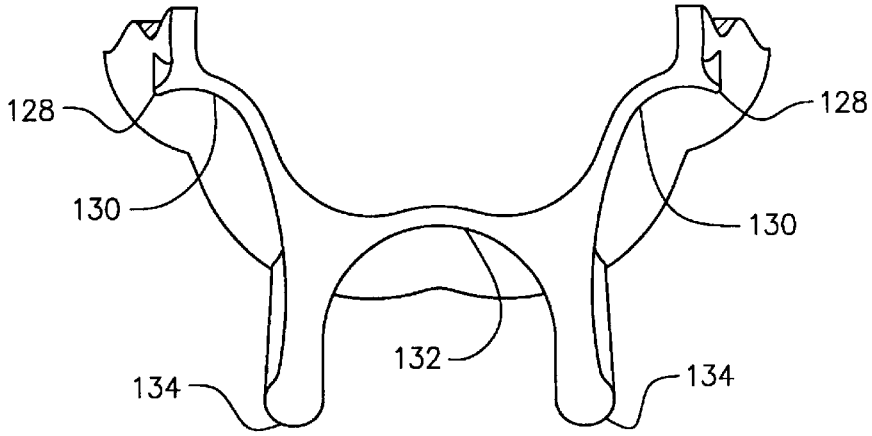

FIGS. 11*a* and 11*b* are representative depictions of a lower cross-sectional portion of a directional nozzle end, showing an example of up to three keel members depending from the nozzle;

FIGS. 12*a* and 12*b* are representative depictions of a lower cross-sectional portion of a directional nozzle end, showing an example of up to three keel members depending from the nozzle, similar to that of FIGS. 11*a* and 11*b* except that the tapered keel(s) are hollow such that a portion of the outlet flow of water can also be directed through the hollow portion of the keel members and exit the back edge of the keel members; and FIGS. 13*a* and 13*b* are schematic depictions of another embodiment wherein as an example, two keel members depend from the nozzle and a longitudinal ridge is formed along either side of the directional nozzle so as to form cupped sides between each keel member and the ridges, and an inverted cup-shaped is also formed on the directional nozzle between the keel members.

Referring now to the drawings, FIGS. 1*a*–1*e* disclose one embodiment of the present invention, which is an auxiliary keel system and is depicted generally as 10. The present invention depicted in these Figures is an auxiliary keel system 10 for a jet propelled watercraft 12 having a directional nozzle drive assembly 14 at the stern 12*a* of the watercraft 12 and a movable hood 16 that rotates over a directional nozzle 18 to downwardly direct and force water from the directional nozzle 18 below the watercraft 12 for providing reverse thrust.

One embodiment of the present invention is an auxiliary keel system 10 which comprises two tie rod members 19, each having a first end 19*a* and a second end 19*b*; and means 20 for attaching the first end 19*a* of each tie rod member 19 to an external portion 22 of the directional nozzle drive assembly 14, wherein the means 20 for attaching the first end 19*a* of each tie rod member 19 to the external portion 22 of the directional nozzle drive assembly 14 moves in unison with the movement of the directional nozzle 18.

Figure 1A:
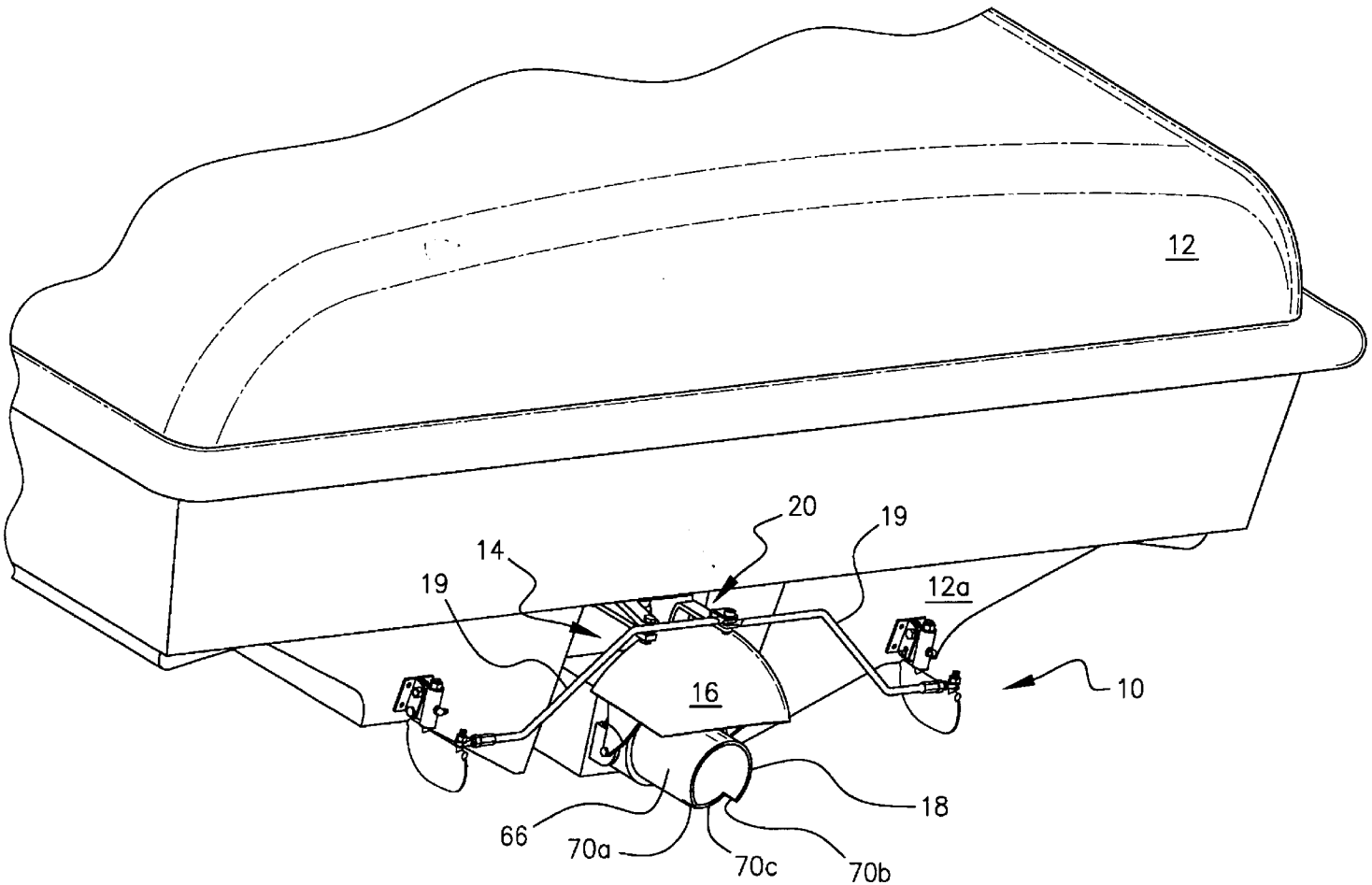
Figure 1B:
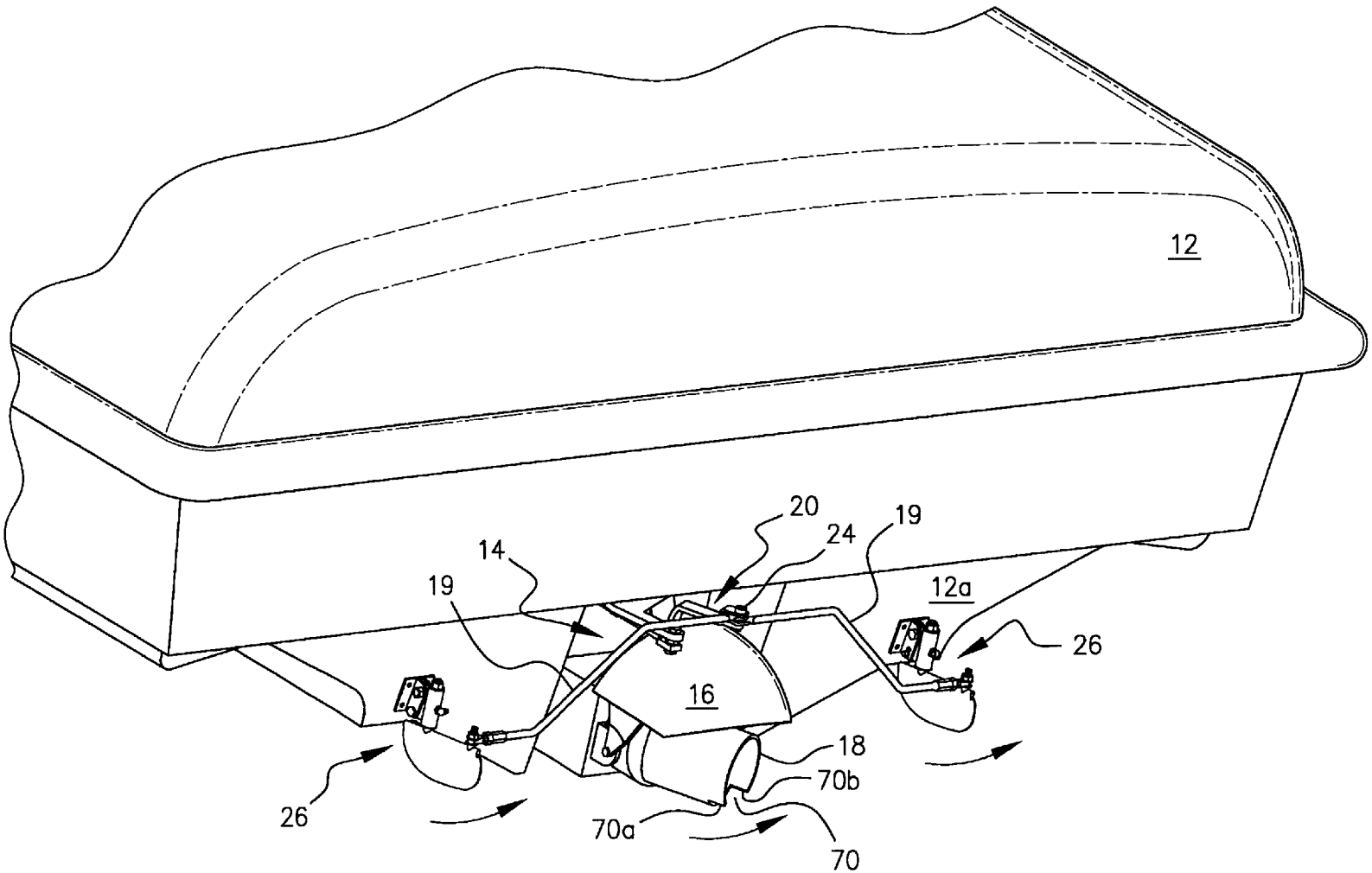
Figure 1C:
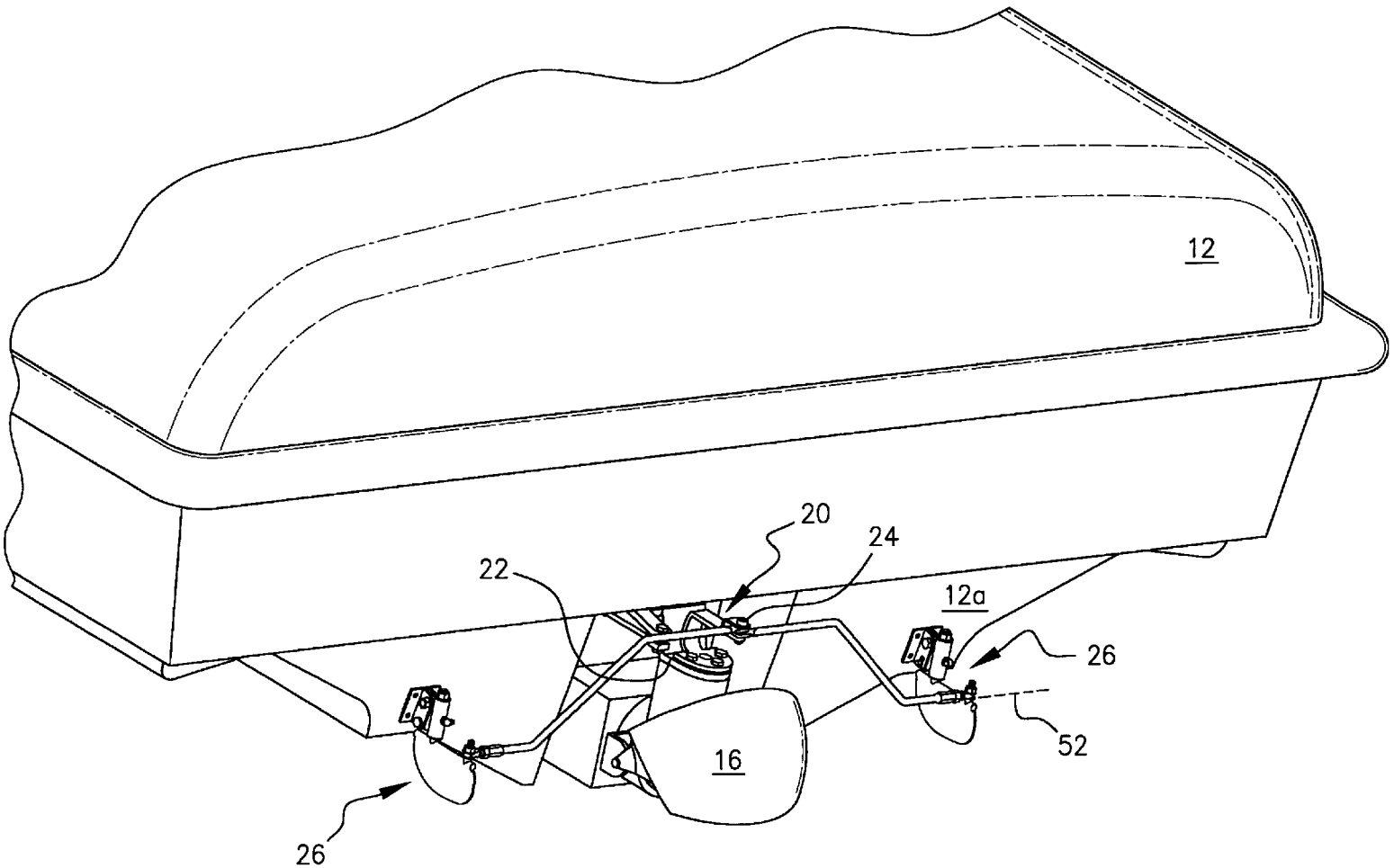

As shown in FIG. 1*b* by the directional arrows for the keels 26 and the directional nozzle 18, the jet boat 12 is depicted as making a right turn and the nozzle 18 and keels 26 move in unison. As the means 20 for attaching the first end 19*a* of each tie rod member 19 to the directional nozzle drive assembly 14 rotates with the movement of the drive assembly 14, the first end 19*a* of the tie rod members 19 pivots at location 24 as shown in FIGS. 1*a*–1*e*.

The first end 19*a* of each tie rod member 19 and the means 20 for attaching the first end 19*a* of each tie rod member 19 to the external portion 22 of the directional nozzle drive assembly 14 is engaged such that the first end 19*a* of each tie rod member 19 is allowed to pivot at location 24 with the movement of the directional nozzle 18.

As shown in the drawings, the tie rod members 19 may be made from round rod and formed to accommodate the installation on the stern 12*a* and drive assembly 14. The tie rod members 19 may be made from steel or aluminum but certainly other products in the polymer industry may be considered. Each end typically has a flat portion with an eyelet through which a pin in inserted about which the tie rod member 19 moves and rotates as the system 10 is operated.

FIGS. 1*a*–1*d* and 1*e* provide two examples of a typical application of making the means 20 for attaching the first end 19*a* of each tie rod member 19 to the external portion 22 of the directional nozzle drive assembly 14. Both methods are designed to avoid interference with the operation of the hood 16. In FIGS. 1*a*–1*d*, the attachment means 20 is designed as a flanged plate for bolting to the drive assembly 14, with an arm that rises and projected rearward away from the stern 12*a* to a fork like engagement portion through which a bolt is inserted to engage the eyelet of the tie rod members 19. Certainly, the fork-like portion could also be wider and narrower such that two parallel pins are used to engage adjoining first ends 19*a* of the tie rod members 19. This alternative for an attachment means 20 can be made from flat stock, round rod stock or a combination of both.

Figure 1D:
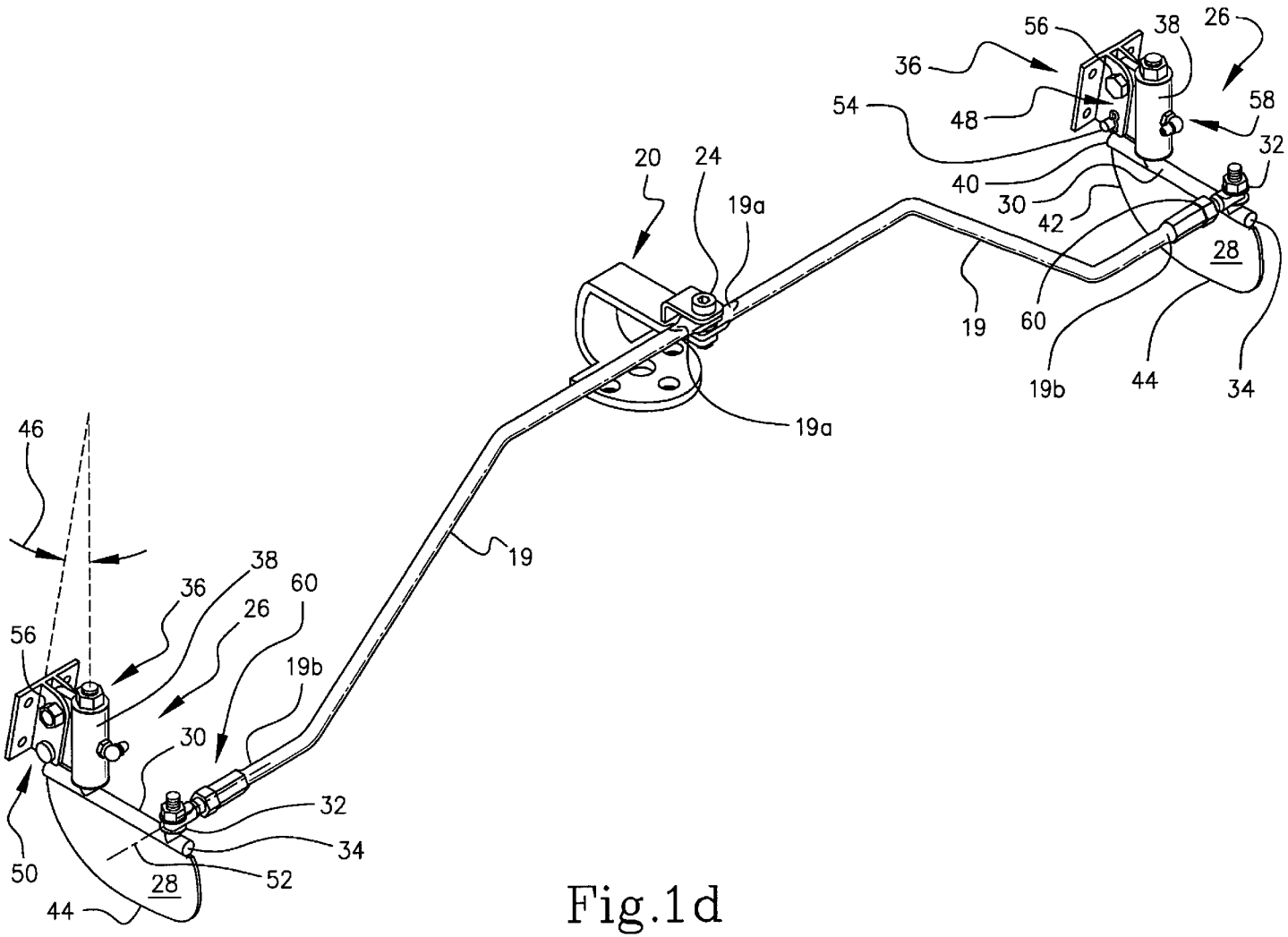
Figure 1E:
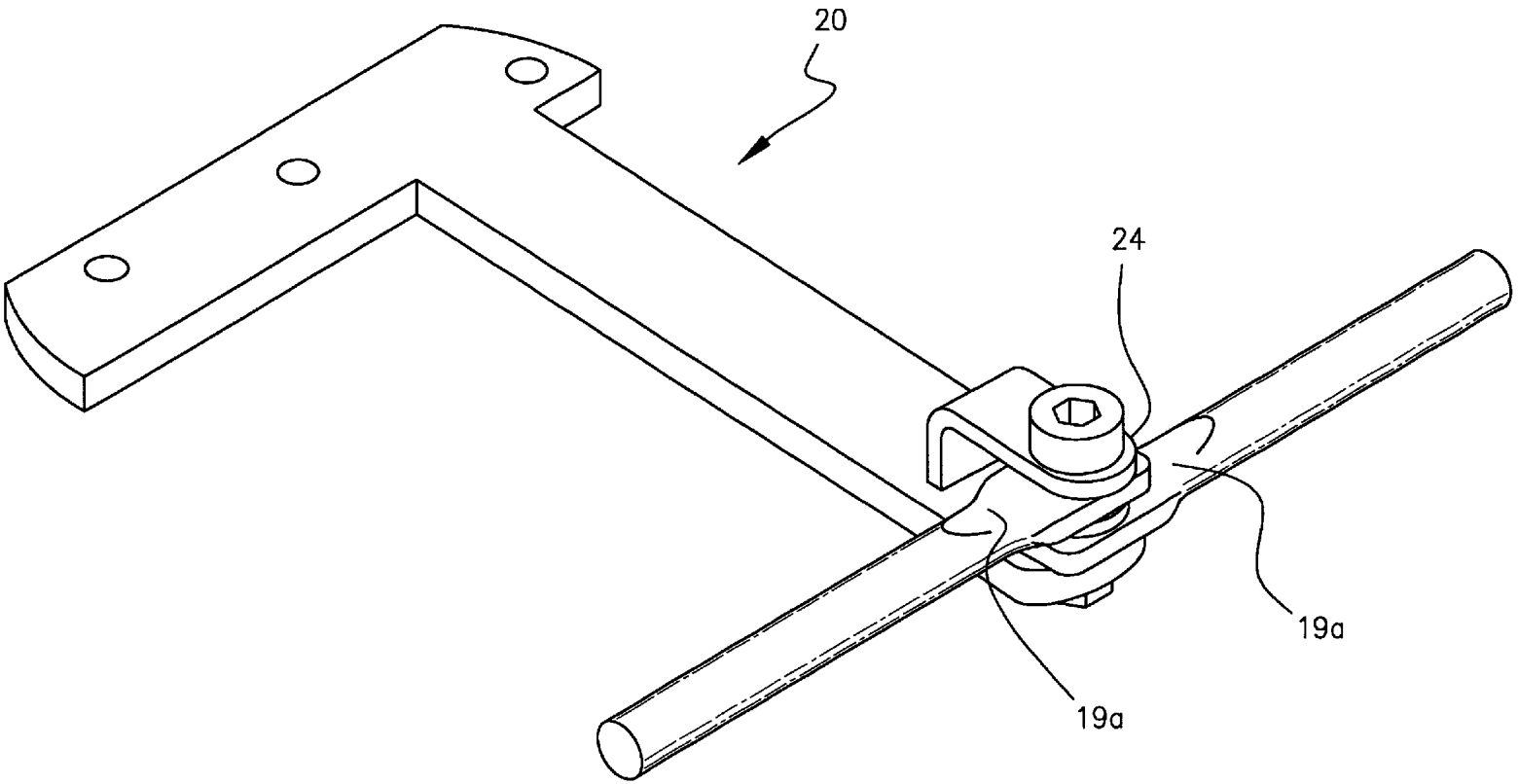

In FIG. 1*e*, flat bar stock forming a T-shape is used whereby the transverse top of the "T" is bolted or fastened to the drive assembly 14 (se apertures for entry of fasteners into drive assembly housing) and the lower end of the leg of the "T" has the fork-like portion similar to that described above. Typically, ¼ inch thick steel or aluminum flat stock should suffice. Using this type of attachment means 20 places the attachments means 20 above the hood 16, which avoids any interference with the hood 16. Of course, this alternative attachment means 20 can also be made from flat stock, round rod stock or a combination of both.

In FIG. 1*d*, it is shown from the perspective view that the apertures in attachment means 20 are recessed. This is done so that the bolt head can be recessed low enough to avoid interference with the hood 16 when it is in the "UP" position as depicted in FIG. 1*a*.

A keel 26 is connected at each of the second end 19*b* of each tie rod member 19. Each keel 26 has a generally planar member 28 forming the keel 26 with a generally horizontal upper edge 30. The second end 19*b* of each tie rod member 19 is pivotally connected near a proximal end 34 of the upper edge 30, as represented at 32.

Also included is means 36 for attaching each keel 26 to the stern 12*a* of the watercraft 12. Each means 36 for attaching the keel 26 to the stern 12*a* of the watercraft 12 further has means 38 for pivotally connecting the upper edge 30 of the keel 26 at a predetermined location between a distal end 40 of the upper edge 30 and the proximal end 34 of the upper edge 30, preferably at an intermediate location approximately midway between the mid-point of the upper edge 30 and its distal end 40.

By having the means 38 for pivotally connecting the upper edge 30 of the keel 26 at a predetermined location between a distal end 40 of the upper edge 30 and the proximal end 34 of the upper edge 30 as depicted in the drawings, hydraulic pressure from the water pressing on the front portion of the keel 26 reduces the pressure applied by the water on the rear portion of the keel 26, which in turn reduces the stress on the steering cable and tie rod members 19, among other components.

As shown in the drawings, a simple application of this pivot feature is the incorporation of a pin that vertically extends from the upper edge 30 through a shaft with provisions such as bearings which allow for lubrication of the shaft as further described below. It is even more desirable that the device be, in effect, a factory sealed greased assembly that does not require further lubrication.

One can surmise from the depictions that the auxiliary keel system 10 presented herein operates such that when the directional nozzle 18 moves, each keel 26 moves in unison with the directional nozzle 18 to provide enhanced steering performance.

The planar member 28 of each keel 26 preferably has a generally tapered arcuate-shaped leading edge 42 extending from the distal end 40 of the upper edge 30 downwardly toward a bottom edge 44 of the keel planar member 28.

Each keel 26 can also be made of steel, aluminum, or durable polymers or plastic materials/composites.

Figure 1F:
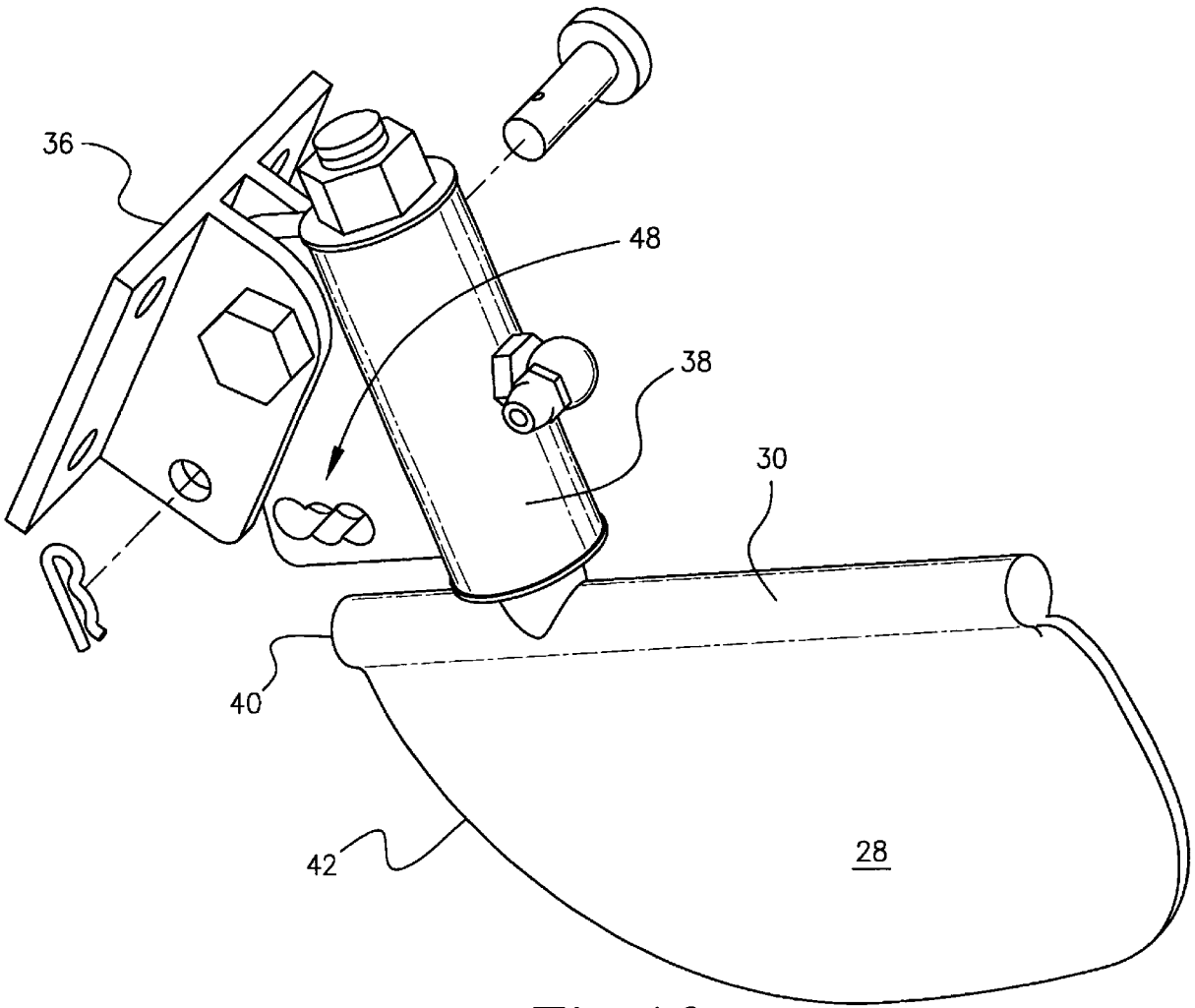

In a preferred application, the means 38 for pivotally connecting the upper edge 30 of the keel 26 is at a predetermined angle 46 relative to the stern 12*a* of the watercraft 12 such that the upper edge 30 of the planar keel member 28 remains generally horizontal in operation and the distal end 40 of the upper edge 30 does not contact the stern 12*a* of the watercraft 12. Preferably, means 48 for adjusting the angle 46 in relation to the stern 12*a* of the watercraft 12 for accommodating an installation such that the distal end 40 of the upper edge 30 does not contact the stern 12*a* of the watercraft 12 are included to provide more flexibility in installing the invention on existing boats 12 with different angular inclines 46 of the stern 12*a*. This can be done in a number of ways known in the art, including the use of slots and multiple holes, engagement gear/teeth locking mechanisms, friction-type engagement mechanism, and similar other adjustment methods and/or combinations of those mentioned. FIG. 1*f*is a conceptual example of one method where a slot with teeth-like spaced-apart protrusions are used for adjustable insertion of a pin.

In another embodiment, the means 36 for attaching each keel 26 to the stern 12*a* of the watercraft 12 further comprises break away means 50 for pivotally enabling the planar keel member 28 to rotate upward and away from the stern 12*a* should the planar member 28 strike an underwater object or surface thereby preventing damage to the keel 26 or to the stern 12*a* of the watercraft 12, wherein the proximal end 34 of the upper edge 30 pivotally rotates about an axis 52 of the second end 19*b* of the tie rod member 19.

In a typical application as shown in the drawings by way of example only, the break away means 50 includes a shear pin designed to shear at a predetermined impact force. The shear pin is located below a pivot pin about which the planar keel member 28 rotates away from the stern 12*a*.

As mentioned above, although a sealed bearing or bushing containing lubrication may be used such as in a factory installation or a permanent sealing characteristic, in a preferred application, the means 38 for pivotally connecting the upper edge 30 of the keel 26 should further comprise means 58 for lubricating said means 38 for pivotally connecting the upper edge 30 of the keel 26. As shown in the drawings, this can be done by simply adding a grease fitting where a white lithium type of grease or other marine type of grease can be periodically added.

Because the widths of the stern portion 12*a* of watercrafts 12 are different and some sterns 12*a* may have contours that would require someone installing the invention to adjust the length of the tie rods 19 so as to mount the keel 26 against a flat area of the stern 12*a*, it is preferable that the second end 19*b* of each tie rod member 19 includes means 60 for adjusting a length of the tie rod member 19. Although there are several ways known in the trade to provide this feature, one example as depicted in the drawings is to have the second end 19*a* be a separate piece which threads inside an axial end (see axis 52) of the tie rod member 19. In this way, fine adjustments can be made by screwing the eyelet end in or out to accommodate the installation of the keel 26 to the stern 12*a*.

Other embodiments described below were developed in anticipation that operators may want a less expensive system that provides the same benefits of the above described embodiment, that is, positive enhanced steering.

Figure 2A:
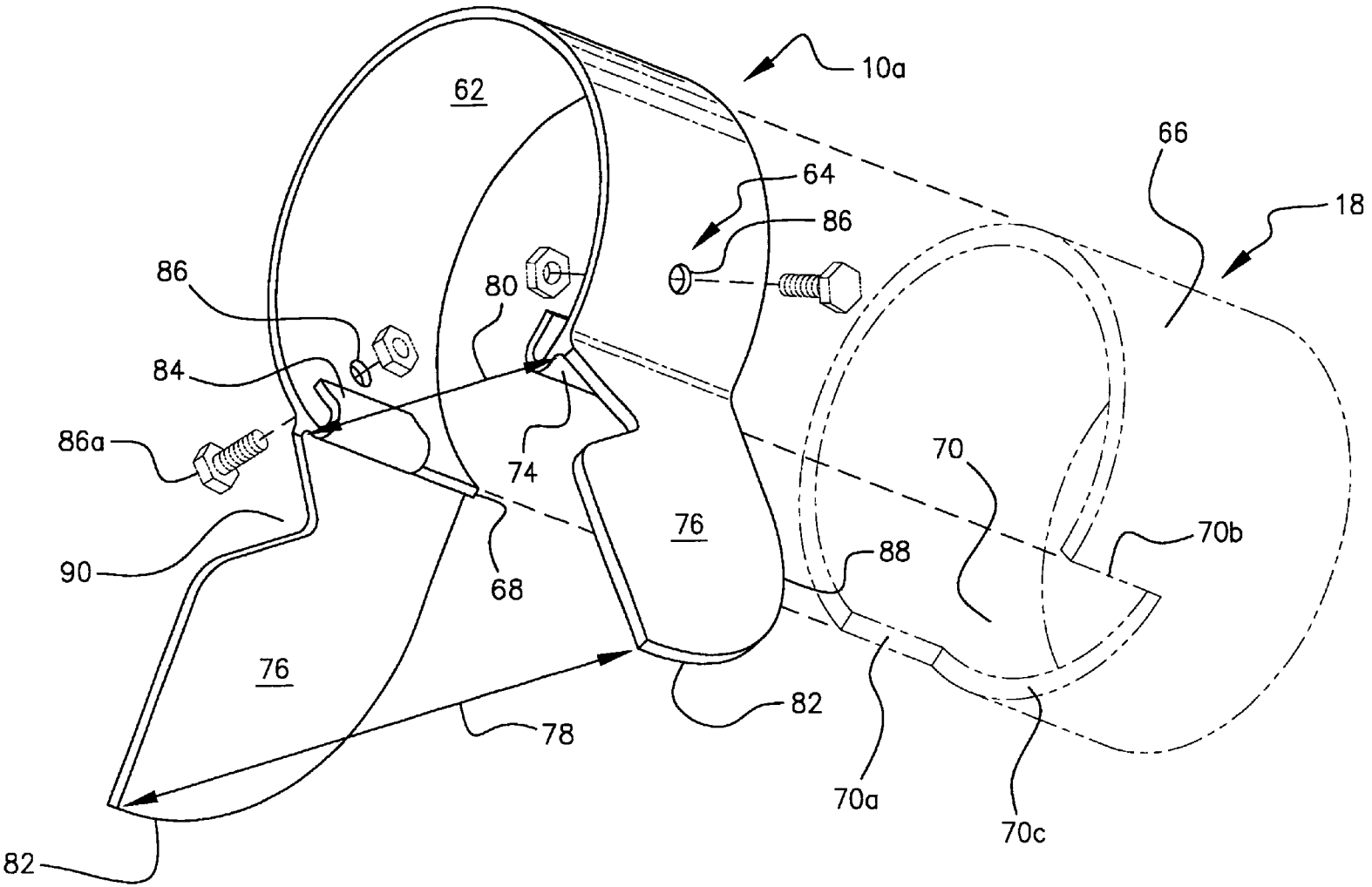
Figure 2B:
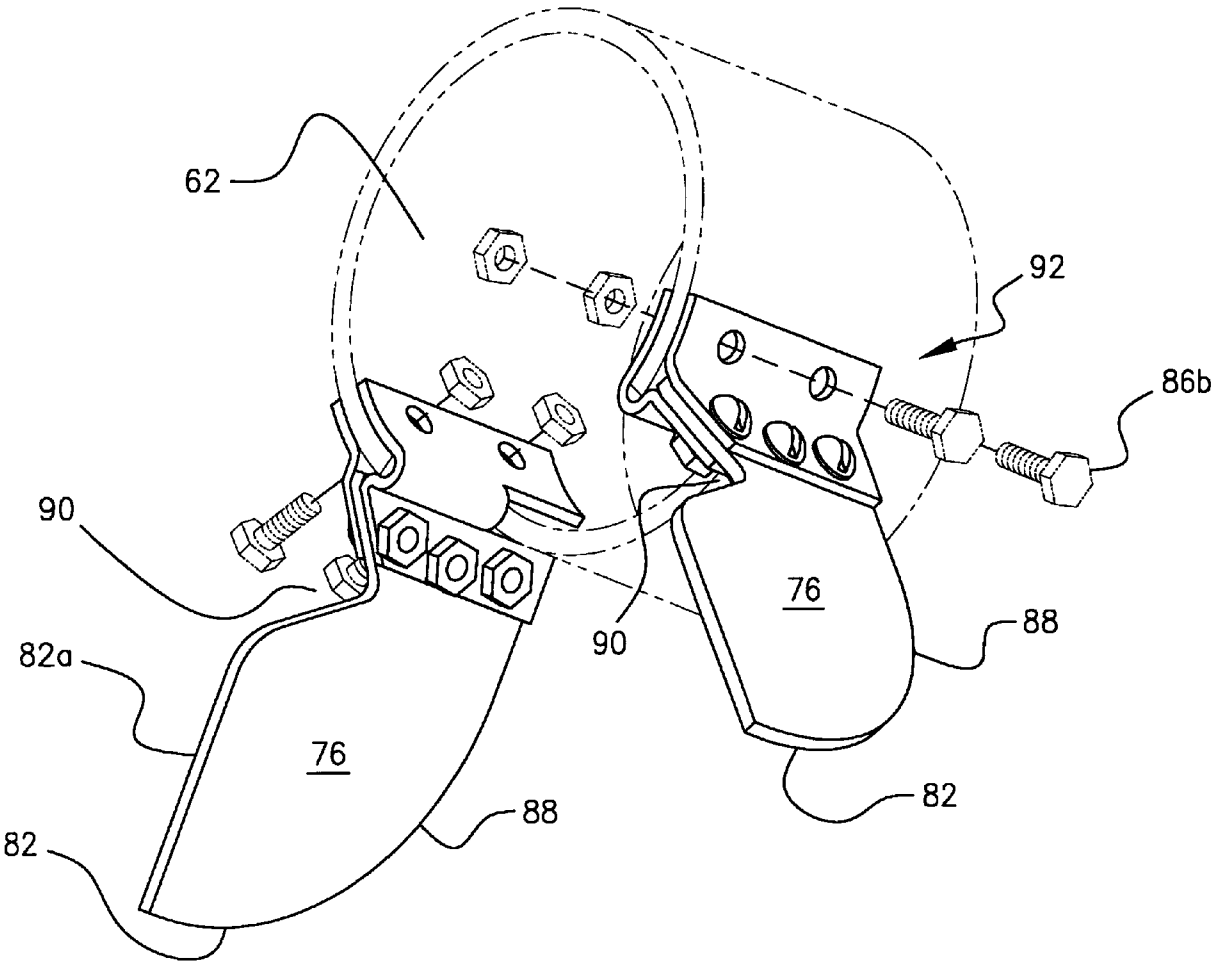

One such embodiment is an auxiliary keel system, depicted generally as 10*a* in FIGS. 2*a*–2*b* for a jet propelled watercraft 12, which as above has a directional nozzle drive assembly 14 at the stern 12*a* of the watercraft 12 and a movable hood 16 as in the above described embodiment, that rotates over a directional nozzle 18 to downwardly direct and force water from the directional nozzle 18 below the watercraft 12 for providing reverse thrust, except that this auxiliary keel system 10*a* has a generally C-shaped portion 62 with means 64 for attaching the C-shaped portion 62 to an outside surface 66 of the directional nozzle 18. The C-shaped portion 62 is adapted to extend from a first end 68 which is adapted to be located near a first side 70*a* of a notch 70 in a bottom outlet portion 70*c* of the directional nozzle 18 around a top surface 72 of the directional nozzle 18 to a second end 74 to be located near a second side 70*b* of the notch 70 in the bottom outlet portion 70*c* of the directional nozzle 18.

The first and second ends 68,74 of the C-shaped portion 62 each have a generally planar keel member 76 angularly depending therefrom so that a distance 80 between a lower edge 82 of each planar keel member 76 is greater than another distance 80 between the first and second ends 68,74 of the C-shaped portion 62.

As with the first described embodiment, the invention is installed such that when the directional nozzle 18 moves, the planar keel members 76 move in unison with the directional nozzle 18 to provide enhanced steering performance.

The means 64 for attaching the C-shaped portion 62 to the outside surface 66 of the directional nozzle 18 includes a generally U-shaped portion 84 extending from at least a portion of each of the first and second ends 68,74 of the C-shaped portion 62. The U-shaped portions 84 are adapted for engaging the corresponding first and second sides 70*a*, 70*b* of the notch 70 in the bottom outlet portion 70*c* of the directional nozzle 18.

Typically, the means 64 for attaching the C-shaped portion to the outside surface 66 of the directional nozzle 18 further includes at least one aperture 86 in the C-shaped portion 62 for inserting means 86*a*,86*b* for fixedly engaging the C-shaped portion to the outside surface 66 of the directional nozzle 18 and for preventing the C-shaped portion 62 from sliding off the directional nozzle 18. For the embodiment shown in either FIGS. 2*a* or 2*b*, the means 86*a*,86*b* for fixedly engaging the C-shaped portion to the outside surface 66 of the directional nozzle 18 is shown as a bolt and nut. However, there are several other known types of fasteners that can be used including screws, quick release pins such as those used for vehicle hitches, etc.

Although a keel plate can have many leading edge designs, it is preferable that each planar keel member 76 has a generally tapered arcuate front edge 88, that is, the edge which is nearest the stern 12*a* of the watercraft 12 when installed.

Because the hood 16 rotates in front of the outlet of the directional nozzle 18 when reverse thrust is needed, there is a possibility that this embodiment may prevent the hood 16 from rotating fully to its desired position. For this reason, it is preferable that each planar keel member 76 has a notched-out portion 90 near an upper back edge 82*a* of said planar keel member 76. The notched-out portion 90, when necessary, is sized to allow the movable hood 16 to be fully lowered to its maximum allowable position without interference from the planar keel member 76.

In cases where it may be advantageous to make the keel plate member 76 from plastic or other polymeric materials so the keel plate 76 would break on hard impact with an object underwater such as a rock in shallow lake waters or hard ground, the invention could be made such that the keel plates or planar members 76 are detachable for replacement without the necessity of replacing the portion 62 that is attached to the directional nozzle 18.

Some jet skis do not have a cover or hood 16 in combination with the directional nozzle 18. In a further embodiment to accommodate this type of personal watercraft 12, the auxiliary keel system, which is depicted generally as 10*b* in FIGS. 3*a*–3*f* comprises a generally C-shaped portion 94 having means 96 for attaching the C-shaped portion 94 to an outside lower surface 98 of the directional nozzle 18.

A generally planar keel member 100 angularly depends from a location near each of a first end 102 and a second end 104 of the C-shaped portion 94 so that a distance 106 between a lower edge 110 of each planar keel member 100 is greater than another distance 108 between the locations from which the planar keel members 100 depend from the C-shaped portion 94.

As with the previously described embodiments, when the directional nozzle 18 moves, the planar keel members 100 move in unison with the directional nozzle 18 to provide enhanced steering performance.

It is preferred that the means 96 for attaching the C-shaped portion 94 to the outside lower surface 98 of the directional nozzle 18 further includes at least two apertures 112 in the C-shaped portion 94 for inserting means 86*a* for fixedly engaging the C-shaped portion 94 to the outside lower surface 98 of the directional nozzle 18.

As with the previously described embodiment, it is preferable that each planar keel member 100 has a generally tapered arcuate-shaped front edge 114, that is, the edge which is nearest the stern 12*a* of the watercraft 12 when installed.

Additionally, as with the previous embodiment, another optional feature is the incorporation of means 116 for detachably connecting each planar keel member 100 to the generally C-shaped portion 94. This allows for cost efficient replacement of any broken keel plate 100 made from plastic or other polymeric materials.

As with any of the above described embodiments, the invention can be made from several materials, including steel, aluminum, polymeric materials including reinforced composites. One skilled in the art can determine the thickness required and the overall size depending on the application and expected hydraulic forces.

Figure 3A:
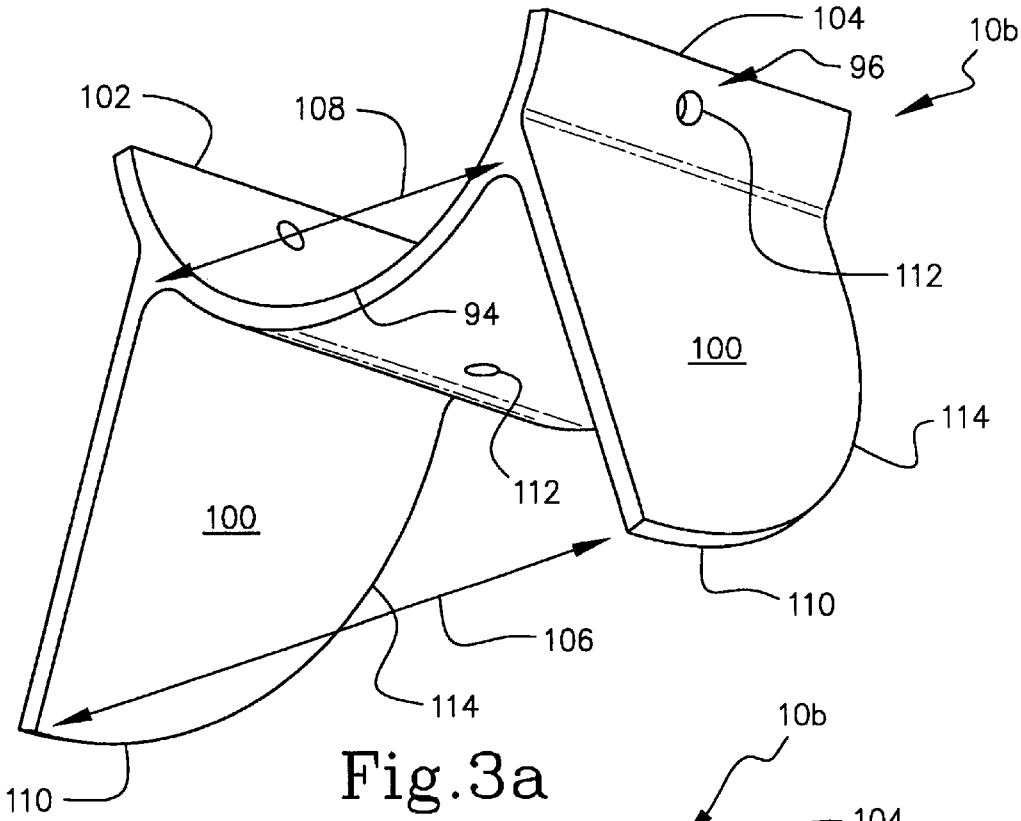
Figure 3B:
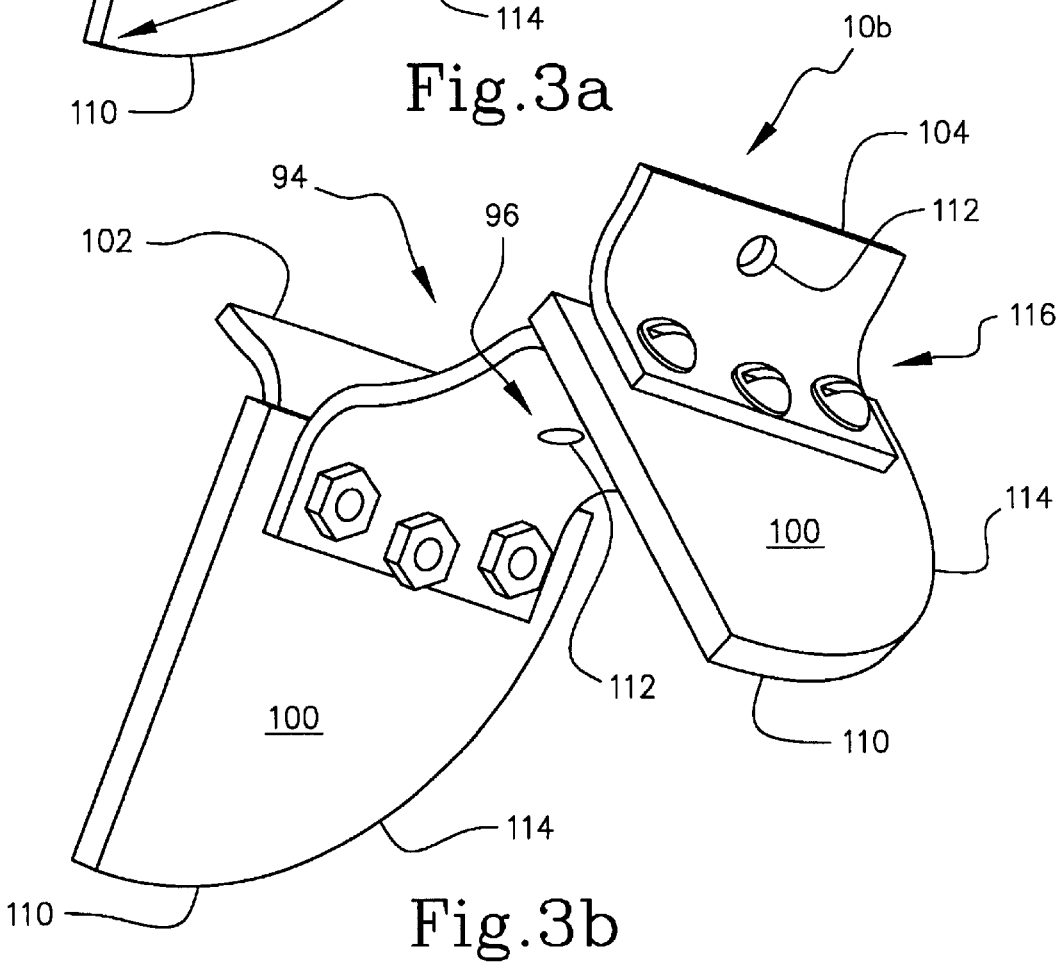
Figure 3C:
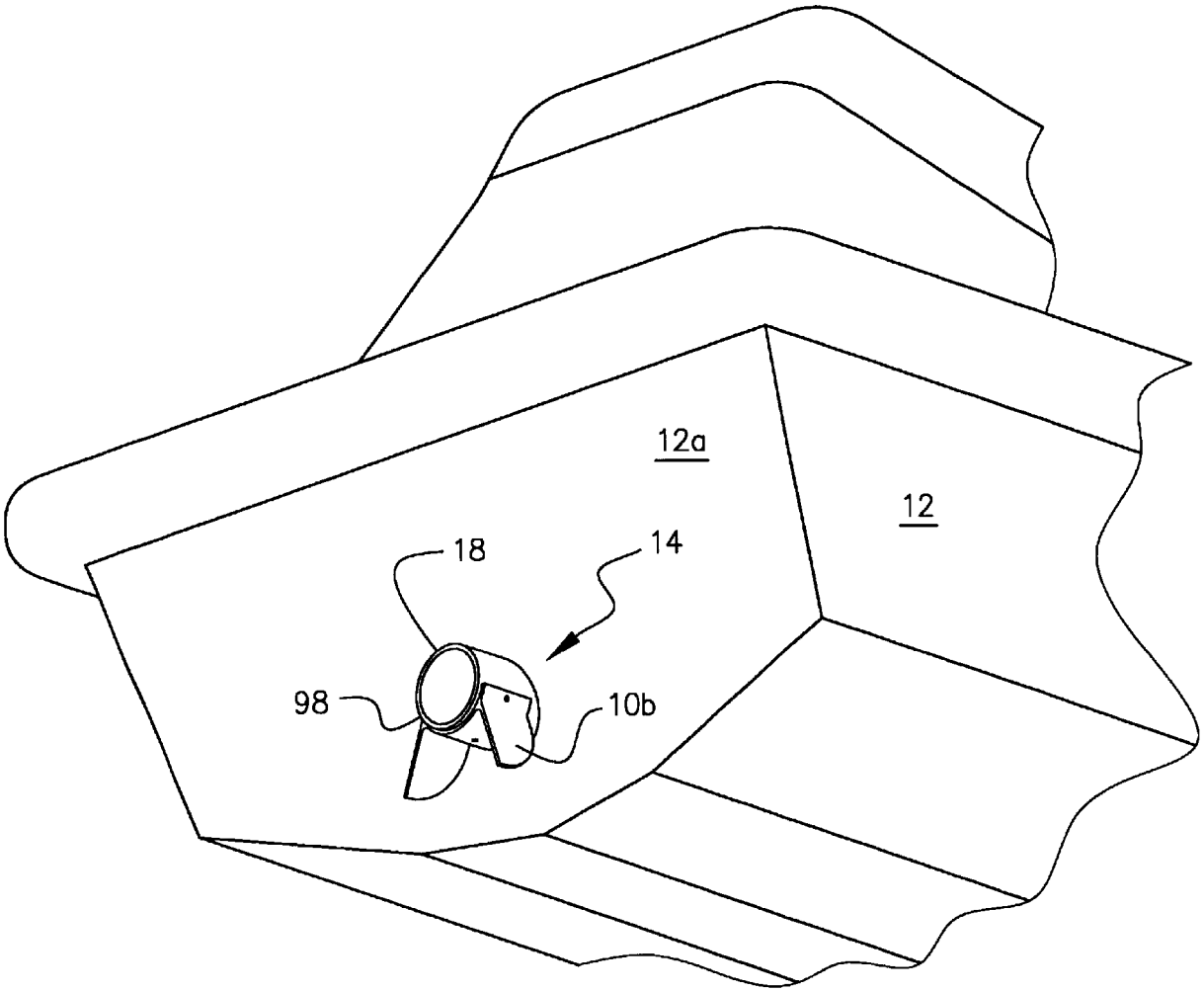
Figure 3D:
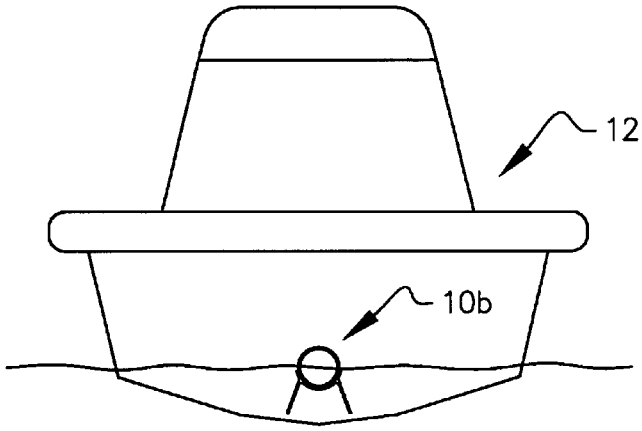
Figure 3E:
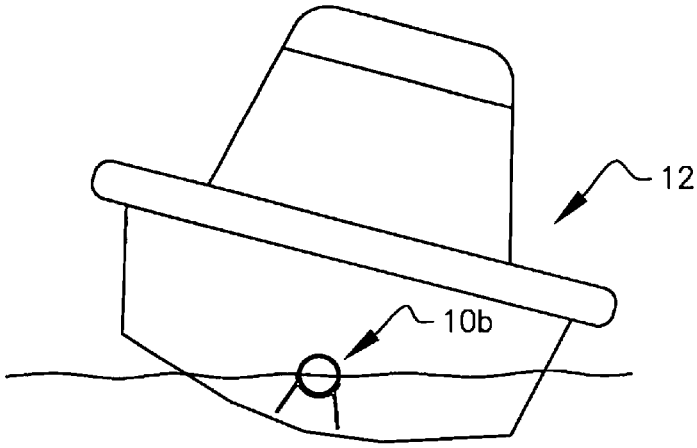
Figure 3F:
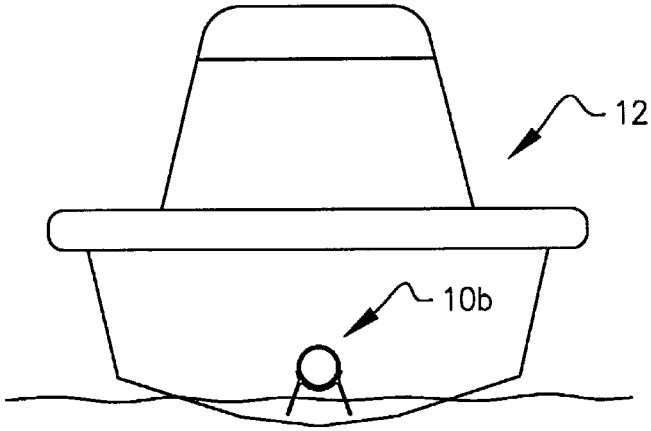

As previously stated above in where the drawings are briefly described, FIG. 3*c* is a depiction of the invention of either FIG. 3*a* or FIG. 3*b* attached to the directional nozzle of a jet ski. As the nozzle moves, the auxiliary keel system moves in unison to provide enhanced positive stability and steering control of the jet ski. Now referring to FIGS. 3*d*–3*f*, FIG. 3*d* is a representation of the invention of FIGS. 3*a* or 3*b* attached to a jet ski with the normal forward movement water line and the keel members submerged below the water line. FIG. 3*e* depicts the jet ski leaning to the starboard to initiate a right turn and the lowered right side keel member provides control assistance to the operator. As the watercraft straightens out and proceeds to a high speed, FIG. 3*f* demonstrates that the keel members typically remain at least partially below the water line, despite the fact that the nozzle itself may rise somewhat above the water line. The submerged keel members enables the operator to maintain turn control at high speeds.

Figure 4:
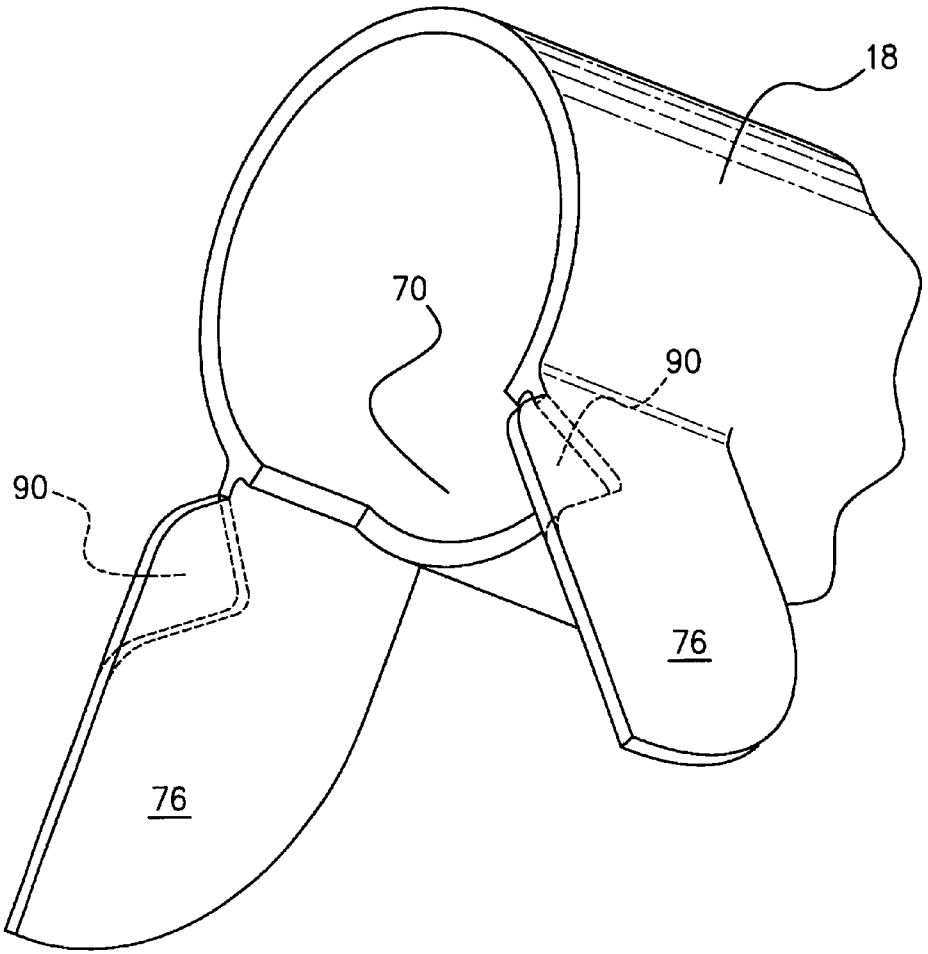
Figure 5A:
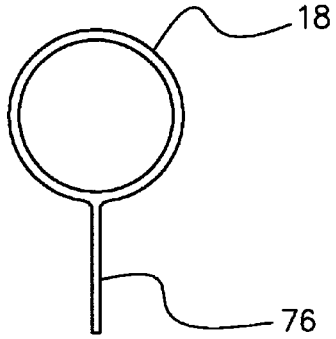
Figure 5B:
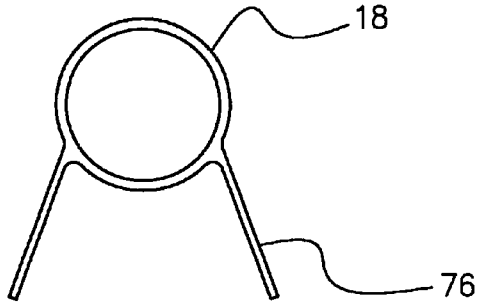
Figure 5C:
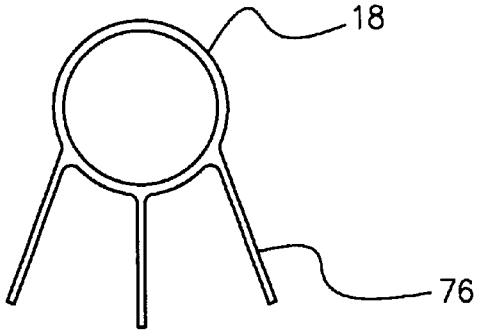
Figure 6A:
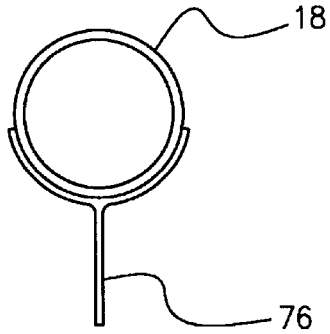
Figure 6B:
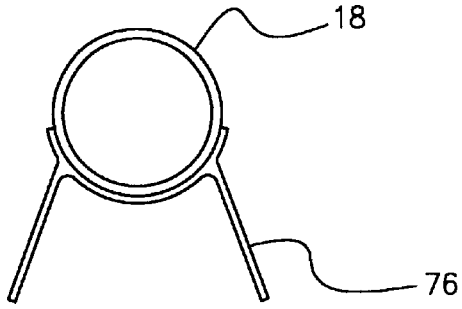
Figure 6C:
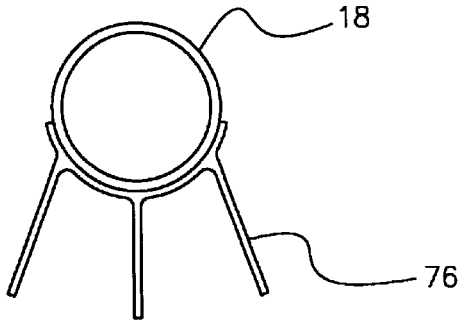
Figure 7A:
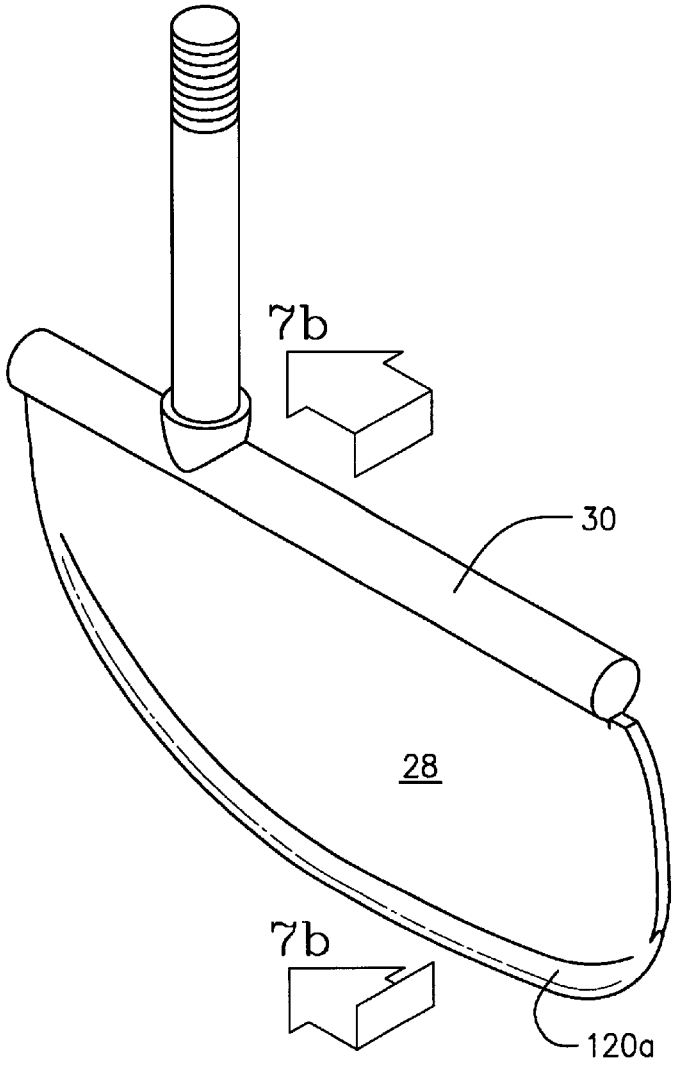
Figure 7B:
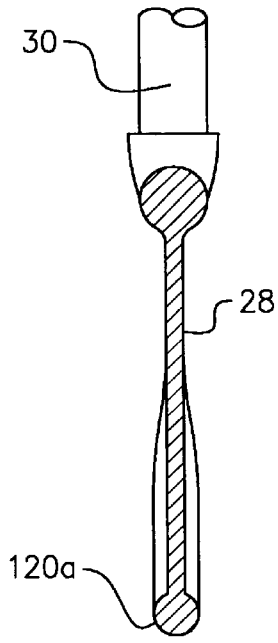

FIG. 4 depicts another embodiment wherein the keel system or keel members 76 described above is incorporated directly into the manufacture of a directional nozzle 18. FIGS. 5*a*–5*c* and 6*a*–6*c* depict conceptually that single keel system where the keel member 76 depends essentially parallel to the center of the directional nozzle 18 to a two keel system to a combination of both embodiments for a three keel system. The difference being that the keel system depicted in FIGS. 5*a*–5*c* is integrally incorporated into the manufacture of a directional nozzle 18 while in the depiction of FIGS. 6*a*–6*c*, the keel members 76 are detachably engaged with the directional nozzle 18, that is, the directional nozzle attachment portion (also referred to herein before as a C-shaped attachment portion) is adapted to fit over the lower outside surface of the directional nozzle 18. Where the keels are integrally formed with the nozzle, the keels can be welded to the nozzle or molded as part of the nozzle fabrication.

To elaborate on the above-described embodiments depicted in FIGS. 5 *a*–5*c* and 6*a*–6*c*, a single keel would provide positive steering at a slow speed and reduce its steering influence as the watercraft tilts into a high speed turn. Two angled keels would provide more steering influence at high speed for precise maneuvering. The three keel system would provide continuous steering influence regardless of the velocity or attitude or pitch of the watercraft. These variations would provide a wide range of assistance levels to meet particular needs of the watercraft operator and allow them to tailor make an auxiliary steering system of their preference.

Generally speaking, most nozzle have a taper to them and the C-shaped attachment portion (or directional nozzle attachment portion) is accordingly adapted to account for the taper. Other nozzle may have irregular shapes in the sense that a portion such as the lower portion may have a rounded or ellipsoidal shape and the upper part may have a polygonal portion. In all cases the attachment portion of the keels would merely be adapted to fit against the surface.

Figure 8A:
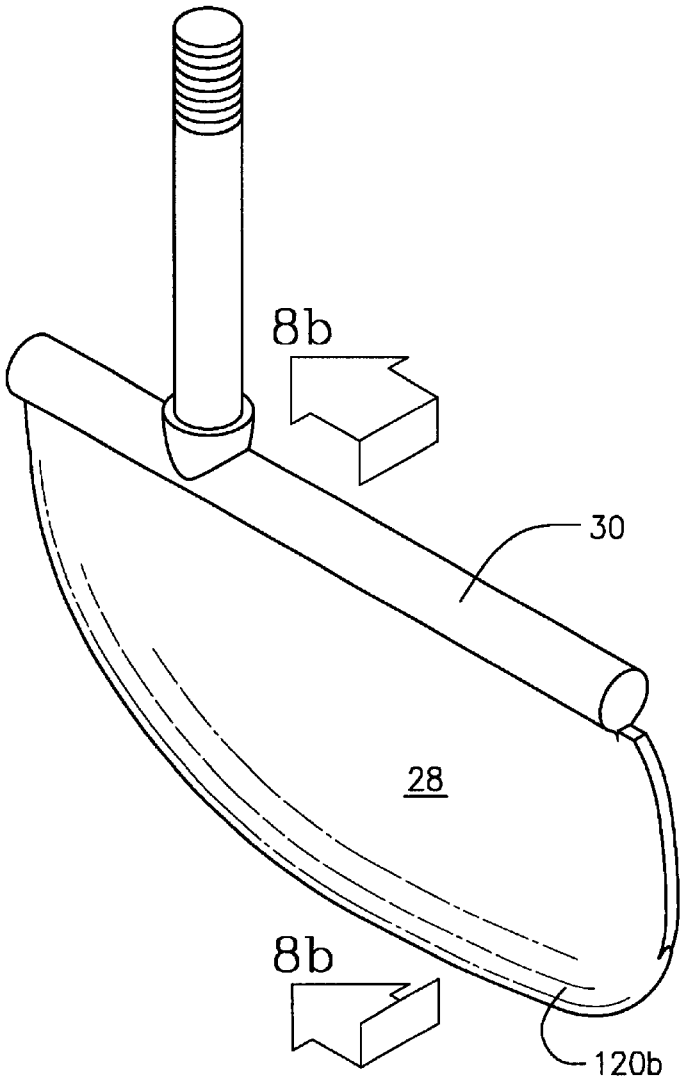
Figure 8B:
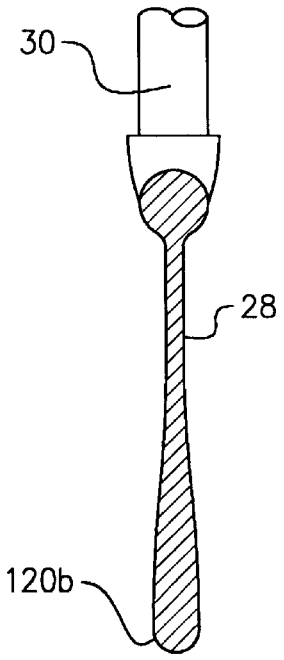

For safety purposes, the bottom edges of the keels are preferably rounded off as shown in FIGS. 7*a*–7*b* and 8*a*–8*b*, numerals 120*a* and 120*b* respectively, with a radius of at least 3/16 inch. This feature can also be included by gradually tapering the keels to widen at the bottom edges to accommodate the rounded bottoms as shown in FIGS. 8*a* and 8*b*.

In addition, in circumstances where the keel member are designed to be part of the directional nozzle, then the tapered keel may be hollow (see 122 in FIGS. 12*a* and 12*b*) such that a portion of the outlet flow of water can also be directed through the hollow portion 122 of the keel members and exit the back edge of the keel members in a substantially parallel direction to the general flow of the water out the directional nozzle. Otherwise, the keel members may be solid as shown as 124 in FIGS. 11*a* and 11*b*.

As an example of another way of providing for a rounded bottom edge, different than that depicted in the drawings, the fins or keel members directly mounted to the directional nozzle, can be straight and tapered up to the front of the directional nozzle. The leading edge may be flat inside and slightly rounded on the outside for safety reasons discussed above. The rounded portion can be gradual so as to disappear toward the front for less drag.

The surfaces of the directional nozzle that would normally be convex on either exterior side of the fins and between the fins can instead be concave and gradually blend into the nozzle body toward the front. See FIGS. 13*a* and 13*b* further described below. This concave design will increase the effect for both high and low speed steering by cupping the water. It will also add to a faster planing during acceleration from an idle speed and lessen high speed hopping (tendency of bow to rise up and drop down) by capturing the passing water and forcing the rear of the watercraft upwardly. Cupping the side of the directional nozzle between the formed ridges 128 and keel members gives extra control for side to side movement.

Figure 9:
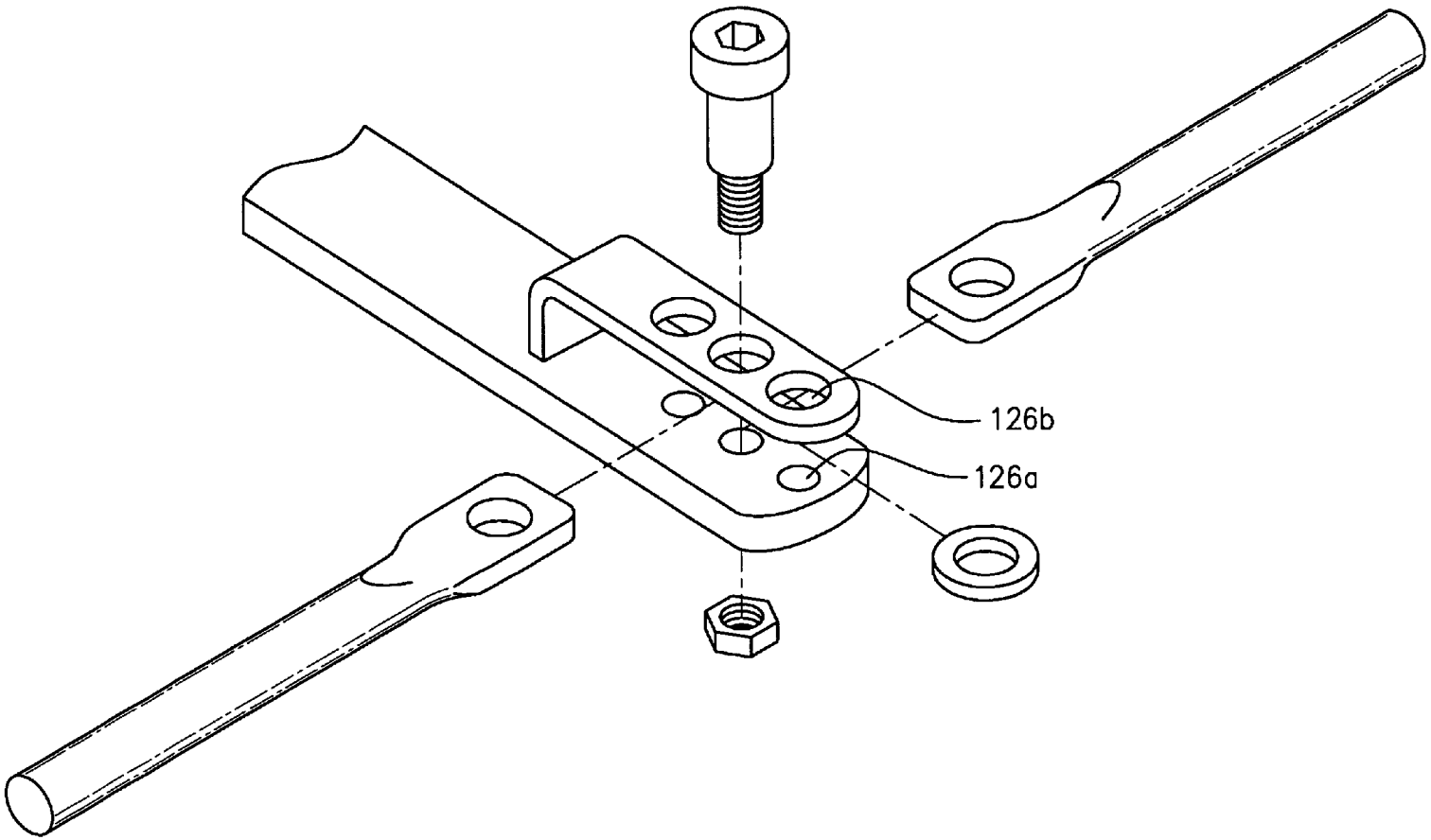
FIG. 9 is a depiction of a typical tie rod connector with an odd number of tie rod connector apertures for adjusting the sensitivity of the steering response.
Figure 10:
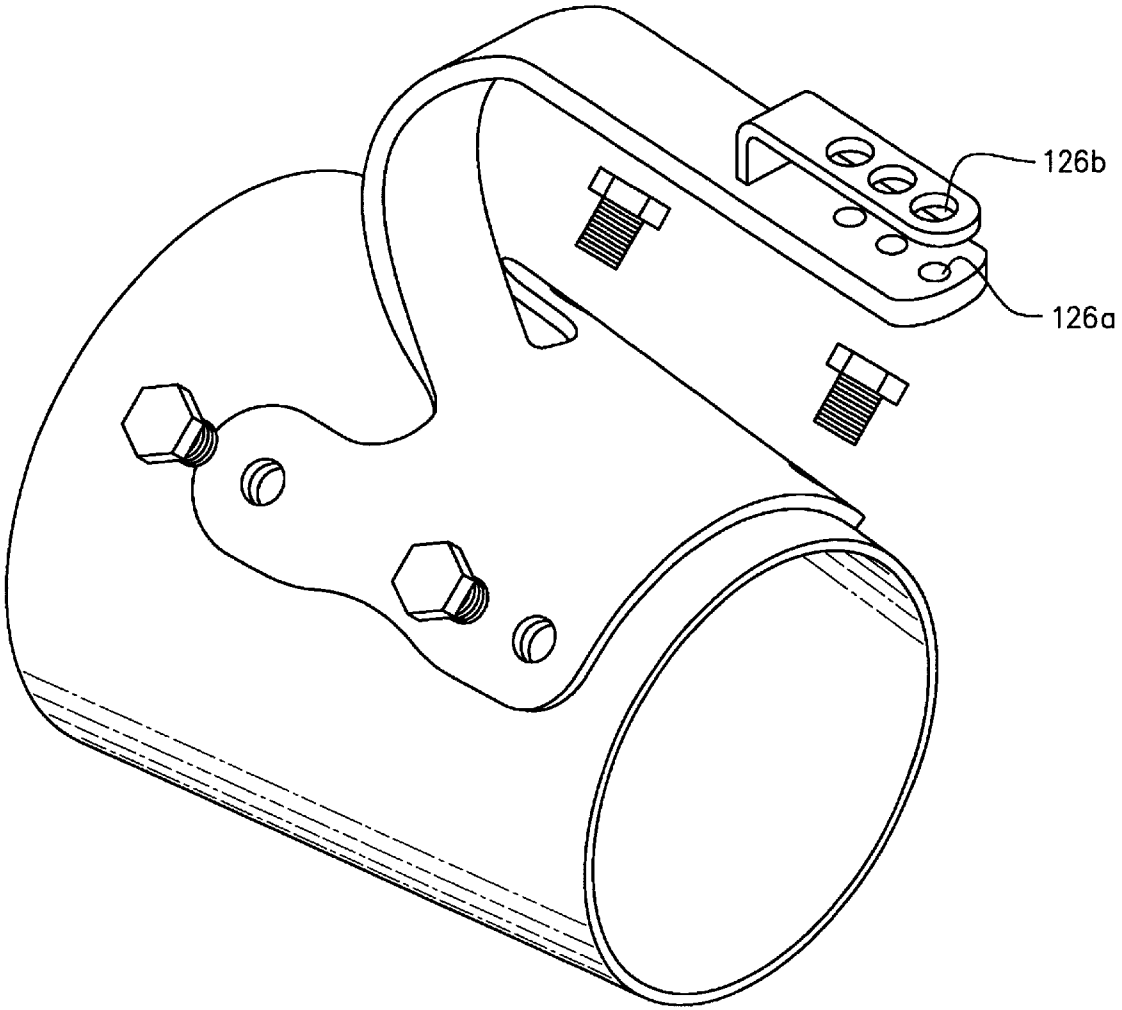
FIG. 10 is a depiction of an embodiment similar to FIG. 9, except that it is incorporated into a universal mount that bolts to assorted jet nozzles and is formed to clear any reverse hoods while operates the tie rods.

If more positive reaction to steering is desired or even less positive reaction to steering is desired, than that obtained through the contemplated 1:1 response in the embodiment using tie rods described above, an odd number of apertures (126*a*, 126*b*), linearly arranged where the tie rod ends are connected together could be provided so that an owner can adjust the sensitivity of the steering response by connecting the tie rod ends to the central aperture for an essentially 1:1 response, to an aperture closer to the stern for a little less rapid and lesser response (less than 1:1) and to an aperture further away for a more rapid and greater response (greater than 1:1). FIG. 9 depicts such an embodiment to hardware similar to that described in FIG. 1*e*. The additional apertures allows the operator to increase or decrease the travel of the keels in proportion to the travel of the nozzle. The further you go the greater the travel related to the keels. The embodiment depicted in FIG. 9 is also depicted in FIG. 10 as a universal steering mount that bolts to assorted jet nozzles and clears any reverse hoods while it operates the tie rods.

FIGS. 13*a* and 13*b* are schematic depictions of another embodiment wherein two or more keel members can be incorporated into a directional nozzle with a ridge 128 being formed along either side of the directional nozzle so as to form cupped sides 130 between each outside keel member and the ridges 128. It is also preferred, but not necessary, that a longitudinal tapered inverted cup-shape 132 be formed on the directional nozzle between the keel members as well. Where the outside keel members depend relatively straight down from the directional nozzle, it is recommended that the most bottom ends 134 of each outside keel member (when two or three keel members are included) be formed to bow or slightly bend outwardly. The benefits for providing these inventive features is discussed above.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

Now that the invention has been described,

What is claimed is:

1. An auxiliary keel system for a jet propelled watercraft having a directional nozzle drive assembly at the stern of the watercraft and a movable hood that rotates over a directional nozzle to downwardly direct and force water from the directional nozzle below the watercraft for providing reverse thrust, the auxiliary keel system comprising:

two tie rod members, each having a first end and a second end;

means for attaching the first end of each tie rod member to an external portion of the directional nozzle drive assembly, wherein the means for attaching the first end of each tie rod member to the external portion of the directional nozzle drive assembly moves in unison with the movement of the directional nozzle;

the first end of each tie rod member and the means for attaching the first end of each tie rod member to the external portion of the directional nozzle drive assembly being engaged such that the first end of each tie rod member is allowed to pivot with the movement of the directional nozzle;

a keel connected at each of the second end of each tie rod member;

each keel being formed as a generally planar member with a generally rounded bottom edge, each keel further having a generally horizontal upper edge, the second end of each tie rod member being pivotally connected near a proximal end of said upper edge, the rounded bottom edge having a radius of 3/16 inches or greater; and means for attaching each keel to the stern of the watercraft, each means for attaching the keel to the stern of the watercraft further having means for pivotally connecting the upper edge of the keel at a predetermined location between a distal end of the upper edge and the proximal end of the upper edge, wherein when the directional nozzle moves, each keel moves in unison with the directional nozzle to provide enhanced steering performance.

2. The auxiliary keel system according to claim 1, wherein the planar member of each keel has a generally tapered arcuate-shaped leading edge extending from the distal end of the upper edge downwardly toward the rounded bottom edge of the keel planar member.

3. The auxiliary keel system according to claim 2, wherein each keel is formed to have a gradual taper from the upper edge to the formed rounded bottom edge.

4. The auxiliary keel system according to claim 1, wherein the means for pivotally connecting the upper edge of the keel is at a predetermined angle in relation to the stern of the watercraft such that the upper edge of the planar keel member remains generally horizontal in operation and the distal end of the upper edge does not contact the stern of the watercraft.

5. The auxiliary keel system according to claim 4, further comprising:

means for adjusting the angle in relation to the stern of the watercraft for accommodating an installation such that the distal end of the upper edge does not contact the stern of the watercraft.

6. The auxiliary keel system according to claim 1, wherein the means for attaching each keel to the stern of the watercraft further comprises:

break away means for pivotally enabling the planar keel member to rotate upward and away from the stern should the planar member strike an underwater object or surface thereby preventing damage to the keel or the stern of the watercraft, wherein the proximal end of the upper edge pivotally rotates about an axis of the second end of the tie rod member.

7. The auxiliary keel system according to claim 6, wherein the break away means includes a shear pin designed to shear at a predetermined impact force, said shear pin being located below a pivot pin about which the planar keel member rotates away from the stern.

8. The auxiliary keel system according to claim 1, wherein the means for pivotally connecting the upper edge of the keel further comprises:

means for lubricating said means for pivotally connecting the upper edge of the keel.

9. The auxiliary keel system according to claim 1, wherein second end of each tie rod member includes means for adjusting a length of the tie rod member for accommodating the installation of the means for attaching each keel to the stern of the watercraft.

10. The auxiliary keel system according to claim 1, wherein the means for attaching the first end of each tie rod member to the external portion of the directional nozzle drive assembly further comprises:

means for adjusting the sensitivity response to the movement of the directional nozzle drive assembly, the means being a plurality of an odd number of spaced-apart apertures for which one is selected for attaching the first end of each tie rod member, wherein selecting the centrally located aperture allows for substantially direct 1:1 response of the keel in relation to the movement of the directional nozzle drive, selecting one of the apertures between the centrally located aperture and the stern allows for a movement of the keel which is less than the movement of the directional nozzle drive, and selecting one of the apertures beyond the centrally located aperture allows for a movement of the keel which is greater than the movement of the directional nozzle drive.

11. An auxiliary keel system for a jet propelled watercraft having a directional nozzle drive assembly at the stern of the watercraft and a movable hood that rotates over a directional nozzle to downwardly direct and force water from the directional nozzle below the watercraft for providing reverse thrust, the auxiliary keel system comprising:

a generally C-shaped portion having means for attaching said C-shaped portion to an outside surface of the directional nozzle and being adapted to extend from a first end adapted to be located near a first side of a notch in a bottom outlet portion of the directional nozzle around a top surface of the directional nozzle to a second end to be located near a second side of the notch in the bottom outlet portion of the directional nozzle; and the first and second ends of the C-shaped portion each having a generally planar keel member angularly depending therefrom so that a distance between a lower edge of each planar keel member is greater than another distance between the first and second ends of the C-shaped portion, each keel member further being formed with a generally rounded bottom edge, the rounded bottom edge having a radius of 3/16 inches or greater, wherein when the directional nozzle moves, the planar keel members move in unison with the directional nozzle to provide enhanced steering performance.

12. The auxiliary keel system according to claim 11, wherein the means for attaching the C-shaped portion to the outside surface of the directional nozzle includes:

a generally U-shaped portion extending from at least a portion of each of the first and second ends of the C-shaped portion, the U-shaped portions being adapted for engaging the corresponding first and second sides of the notch in the bottom outlet portion of the directional nozzle.

13. The auxiliary keel system according to claim 12, wherein the means for attaching the C-shaped portion to the outside surface of the directional nozzle further includes:

at least one aperture in the C-shaped portion for inserting means for fixedly engaging the C-shaped portion to the outside surface of the directional nozzle and for preventing the C-shaped portion from sliding off the directional nozzle.

14. The auxiliary keel system according to claim 11, wherein each planar keel member has a generally tapered arcuate front edge, said edge being nearest the stern of the watercraft when installed.

15. The auxiliary keel system according to claim 11, wherein each planar keel member is further formed to have a gradual taper from the C-shaped portion to the formed rounded bottom edge.

16. The auxiliary keel system according to claim 11, wherein each planar keel member has a notched-out portion near an upper back edge of said planar keel member, said notched-out portion being sized to allow the movable hood to be fully lowered to its maximum allowable position without interference from the planar keel member.

17. The auxiliary keel system according to claim 11, further comprising:

means for detachably connecting each planar keel member to the corresponding first and second ends of the C-shaped portion.

18. The auxiliary keel system according to claim 11, further comprising generally longitudinal ridges along each side of the C-shaped portion near the first and second ends of said C-shaped portion to form a slight cup between the keel members and the longitudinal ridges.

19. The auxiliary keel system according to claim 11, wherein the bottom edge of each keel member is bowed outwardly.

20. An auxiliary keel system for a jet propelled watercraft having a directional nozzle drive assembly at the stern of the watercraft, the auxiliary keel system comprising:

a generally C-shaped portion having means for attaching said C-shaped portion to an outside lower surface of the directional nozzle; and a generally planar keel member angularly depending from a location near each of a first end and a second end of the C-shaped portion so that a distance between a lower edge of each planar keel member is greater than another distance between the locations from which the planar keel members depend from the C-shaped portion, each keel member further being formed with a generally rounded bottom edge, the rounded bottom edge having a radius of 3/16 inches or greater, wherein when the directional nozzle moves, the planar keel members move in unison with the directional nozzle to provide enhanced steering performance.

21. The auxiliary keel system according to claim 20, wherein the means for attaching the C-shaped portion to the outside lower surface of the directional nozzle further includes:

at least two apertures in the C-shaped portion for inserting means for fixedly engaging the C-shaped portion to the outside lower surface of the directional nozzle.

22. The auxiliary keel system according to claim 20, wherein each planar keel member has a generally tapered arcuate-shaped front edge, said edge being nearest the stern of the watercraft when installed.

23. The auxiliary keel system according to claim 20, wherein each planar keel member is further formed to have a gradual taper from the C-shaped portion to the formed rounded bottom edge.

24. The auxiliary keel system according to claim 20, further comprising:

means for detachably connecting each planar keel member to the generally C-shaped portion.

25. The auxiliary keel system according to claim 20, further comprising generally longitudinal ridges along each outer edge of the C-shaped to form a slight cup between the keel members and the longitudinal ridges.

26. The auxiliary keel system according to claim 20, wherein the bottom edge of each keel member is bowed outwardly.

27. An auxiliary keel system for a jet propelled watercraft having a directional nozzle drive assembly at the stern of the watercraft and a movable hood that rotates over a directional nozzle to downwardly direct and force water from the directional nozzle below the watercraft for providing reverse thrust, the auxiliary keel system comprising:

a directional nozzle attachment portion having means for attaching said directional nozzle attachment portion to an outside surface of the directional nozzle and being adapted to extend from a first end adapted to be located near a first side of a notch in a bottom outlet portion of the directional nozzle around a top surface of the directional nozzle to a second end to be located near a second side of the notch in the bottom outlet portion of the directional nozzle; and the first and second ends of the directional nozzle attachment portion each having a generally planar keel member angularly depending therefrom so that a distance between a lower edge of each planar keel member is greater than another distance between the first and second ends of the directional nozzle attachment portion, each keel member further being formed with a generally rounded bottom edge, the rounded bottom edge having a radius of 3/16 inches or greater, wherein when the directional nozzle moves, the planar keel members move in unison with the directional nozzle to provide enhanced steering performance.

28. The auxiliary keel system according to claim 27, wherein the means for attaching the directional nozzle attachment portion to the outside surface of the directional nozzle includes:

a generally U-shaped portion extending from at least a portion of each of the first and second ends of the directional nozzle attachment portion, the U-shaped portions being adapted for engaging the corresponding first and second sides of the notch in the bottom outlet portion of the directional nozzle.

29. The auxiliary keel system according to claim 28, wherein the means for attaching the directional nozzle attachment portion to the outside surface of the directional nozzle further includes:

at least one aperture in the directional nozzle attachment portion for inserting means for fixedly engaging the directional nozzle attachment portion to the outside surface of the directional nozzle and for preventing the directional nozzle attachment portion from sliding off the directional nozzle.

30. The auxiliary keel system according to claim 27, wherein each planar keel member has a generally tapered arcuate front edge, said edge being nearest the stern of the watercraft when installed.

31. The auxiliary keel system according to claim 27, wherein each planar keel member is further formed to have a gradual taper from the directional nozzle attachment portion to the formed rounded bottom edge.

32. The auxiliary keel system according to claim 27, wherein each planar keel member has a notched-out portion near an upper back edge of said planar keel member, said notched-out portion being sized to allow the movable hood to be fully lowered to its maximum allowable position without interference from the planar keel member.

33. The auxiliary keel system according to claim 27, further comprising:

means for detachably connecting each planar keel member to the corresponding first and second ends of directional nozzle attachment portion.

34. The auxiliary keel system according to claim 27, further comprising generally longitudinal ridges along each side of the directional nozzle attachment portion near the first and second ends of said directional nozzle attachment portion to form a slight cup between the keel members and the longitudinal ridges.

35. The auxiliary keel system according to claim 27, wherein the bottom edge of each keel member is bowed outwardly.

36. An auxiliary keel system for a jet propelled watercraft having a directional nozzle drive assembly at the stern of the watercraft, the auxiliary keel system comprising:

a directional nozzle attachment portion having means for attaching said directional nozzle attachment portion to an outside lower surface of the directional nozzle; and a generally planar keel member depending from one of a location proximately aligned parallel to a center of the directional nozzle, spaced-apart on the directional nozzle attachment portion so that a distance between a lower edge of each planar keel member is greater than another distance between the locations from which the planar keel members depend from the directional nozzle attachment portion, and a combination of such locations to form three keel members depending from the directional nozzle attachment portion, each keel member further being formed with a generally rounded bottom edge, the rounded bottom edge having a radius of 3/16 inches or greater, wherein when the directional nozzle moves, the planar keel members move in unison with the directional nozzle to provide enhanced steering performance.

37. The auxiliary keel system according to claim 36, wherein the means for attaching the directional nozzle attachment portion to the outside lower surface of the directional nozzle further includes:

at least two apertures in the directional nozzle attachment portion for inserting means for fixedly engaging the directional nozzle attachment portion to the outside lower surface of the directional nozzle.

38. The auxiliary keel system according to claim 36, wherein each planar keel member has a generally tapered arcuate-shaped front edge, said edge being nearest the stern of the watercraft when installed.

39. The auxiliary keel system according to claim 36, wherein each planar keel member is further formed to have a gradual taper from the directional nozzle attachment portion to the formed rounded bottom edge.

40. The auxiliary keel system according to claim 36, further comprising:

means for detachably connecting each planar keel member to the directional nozzle attachment portion.

41. The auxiliary keel system according to claim 36, wherein each planar keel member has a notched-out portion near an upper back edge of said planar keel member, said notched-out portion being sized to allow the movable hood to be fully lowered to its maximum allowable position without interference from the planar keel member.

42. The auxiliary keel system according to claim 36, further comprising generally longitudinal ridges along each side of the directional nozzle attachment portion to form a slight cup between the keel members and the longitudinal ridges.

43. The auxiliary keel system according to claim 36, wherein the bottom edge of each keel member is bowed outwardly.

44. An auxiliary keel system for a jet propelled watercraft having a directional nozzle drive assembly at the stern of the watercraft, the auxiliary keel system comprising:

a directional nozzle; and a generally planar keel member depending from the directional nozzle at one of a location proximately aligned parallel to a center of the directional nozzle, spaced-apart and divergently depending angularly from the directional nozzle such that a distance between a lower edge of each planar keel member is greater than another distance between the locations from which the planar keel members depend from the directional nozzle, and a combination of such locations to form three keel members depending from the directional nozzle, each keel member further being formed with a generally rounded bottom edge, the rounded bottom edge having a radius of 3/16 inches or greater, wherein when the directional nozzle moves, the planar keel members move in unison with the directional nozzle to provide enhanced steering performance.

45. The auxiliary keel system according to claim 44, wherein each planar keel member has a generally tapered arcuate-shaped front edge, said edge being nearest the stern of the watercraft when installed.

46. The auxiliary keel system according to claim 44, wherein each planar keel member is further formed to have a gradual taper from the directional nozzle to the formed rounded bottom edge.

47. The auxiliary keel system according to claim 44, further comprising:

means for detachably connecting each planar keel member to the directional nozzle.

48. The auxiliary keel system according to claim 44, wherein each planar keel member has a notched-out portion near an upper back edge of said planar keel member.

49. The auxiliary keel system according to claim 46, wherein each gradual tapered keel member has a hollow interior in fluid communication with the directional nozzle so that a portion of the outflow of the water can be directed into the hollow interior of each keel member and subsequently flow out of the keel member's back edge.

50. The auxiliary keel system according to claim 44, further comprising a generally longitudinal ridge along each side of the directional nozzle to form a cup shape between the each longitudinal ridge and its nearest keel member.

51. The auxiliary keel system according to claim 44, wherein the bottom edge of each keel member is bowed outwardly.

52. The auxiliary keel system according to claim 44, wherein when two or more keel members are used, an inverted U-shaped cup is formed between adjacent keel members on the directional nozzles.

* * * * *